US011352233B2

(12) United States Patent
Hirako et al.

(10) Patent No.: US 11,352,233 B2
(45) Date of Patent: Jun. 7, 2022

(54) SHEET STACKING DEVICE AND IMAGE FORMING SYSTEM INCLUDING SAME

(71) Applicants: Hiroshi Hirako, Kanagawa (JP); Kentaroh Fukami, Kanagawa (JP)

(72) Inventors: Hiroshi Hirako, Kanagawa (JP); Kentaroh Fukami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 172 days.

(21) Appl. No.: 16/749,032

(22) Filed: Jan. 22, 2020

(65) Prior Publication Data

US 2020/0239263 A1 Jul. 30, 2020

(30) Foreign Application Priority Data

Jan. 28, 2019 (JP) ..... JP2019-012518

(51) Int. Cl.

| | |
|---|---|
| ***B65H 31/30*** | (2006.01) |
| ***B65H 29/28*** | (2006.01) |
| ***B65H 31/34*** | (2006.01) |
| ***B65H 31/24*** | (2006.01) |

(Continued)

(52) U.S. Cl.

CPC ..... *B65H 31/3063* (2013.01); *B65H 9/101* (2013.01); *B65H 29/28* (2013.01); *B65H 29/34* (2013.01); *B65H 31/24* (2013.01); *B65H 31/3018* (2013.01); *B65H 31/34* (2013.01);

(Continued)

(58) Field of Classification Search

CPC ..... B65H 9/101; B65H 29/26; B65H 29/34; B65H 29/38; B65H 29/46; B65H 31/20; B65H 31/30; B65H 31/3009; B65H 31/3018; B65H 31/3054; B65H 31/3063; B65H 31/34; B65H 2402/441;

(Continued)

(56) References Cited

U.S. PATENT DOCUMENTS

| | | | | |
|---|---|---|---|---|
| 6,231,039 | B1 * | 5/2001 | Chung | B65H 31/3018 270/58.12 |
| 9,676,581 | B2 * | 6/2017 | Okawa | B65H 29/14 |
| 2010/0019435 | A1 | 1/2010 | Fukami | |

(Continued)

FOREIGN PATENT DOCUMENTS

| | | |
|---|---|---|
| JP | 11-217150 | 8/1999 |
| JP | 2013-112479 | 6/2013 |
| JP | 2016-199396 | 12/2016 |

*Primary Examiner* — Prasad V Gokhale

(74) *Attorney, Agent, or Firm* — Harness, Dickey & Pierce, P.L.C.

(57) ABSTRACT

A sheet stacking device includes a pair of first sheet stackers, a pair of sheet alignment members, a second sheet stacker, a sheet removal portion, and control circuitry. The first sheet stackers stack both end portions of a sheet in a direction orthogonal to a sheet ejecting direction. The sheet alignment members contact both ends of the sheet in the orthogonal direction to align the sheet on the first sheet stackers. The second sheet stacker is disposed lower than the first sheet stackers and stacks the sheet dropped from between the first sheet stackers. The sheet removal portion is disposed on one side in the orthogonal direction. The control circuitry causes one of the first sheet stackers and one of the sheet alignment members to move toward an opposite side of the sheet removal portion in the orthogonal direction after the sheet is dropped from between the first sheet stackers.

11 Claims, 26 Drawing Sheets

(51) Int. Cl.
*B65H 9/10* (2006.01)
*B65H 29/34* (2006.01)

(52) U.S. Cl.
CPC .... *B65H 2405/332* (2013.01); *B65H 2407/33* (2013.01); *B65H 2601/321* (2013.01)

(58) Field of Classification Search
CPC ..... B65H 2405/332; B65H 2407/20; B65H 2407/33; B65H 2601/321; B65H 2601/325
See application file for complete search history.

(56) References Cited

U.S. PATENT DOCUMENTS

| | | | | |
|---|---|---|---|---|
| 2010/0237556 | A1 | 9/2010 | Azuma et al. | |
| 2011/0024973 | A1* | 2/2011 | Sekiyama ..... | G03G 15/6552 271/314 |
| 2011/0074081 | A1 | 3/2011 | Hirabayashi et al. | |
| 2012/0217693 | A1 | 8/2012 | Fukami | |
| 2013/0236227 | A1 | 9/2013 | Hirako | |
| 2015/0321871 | A1 | 11/2015 | Nakagawa et al. | |
| 2019/0233237 | A1 | 8/2019 | Kawasaki et al. | |

* cited by examiner

SHEET STACKING DEVICE AND IMAGE FORMING SYSTEM INCLUDING SAME

CROSS-REFERENCE TO RELATED APPLICATIONS

This patent application is based on and claims priority pursuant to 35 U.S.C. § 119(a) to Japanese Patent Application No. 2019-012518, filed on Jan. 28, 2019, in the Japan Patent Office, the entire disclosure of which is incorporated by reference herein.

BACKGROUND

Technical Field

Aspects of the present disclosure relates to a sheet stacking device and an image forming system including the sheet stacking device.

Discussion of the Background Art

In recent years, more information tends to be digitized, and an image processing apparatus used to output the digitized information has become indispensable equipment. Such an image processing apparatus includes a reading function to read a sheet, an image forming function to form an image on a sheet, a communication function, and the like. Thus, the image processing apparatus can be utilized as a printer, a scanner, a facsimile machine, and a copy machine.

Also, there may be an image processing apparatus including a sheet stacking device that stacks, on a processing tray, a plurality of paper sheets after image formation, aligns these paper sheets, and binds the paper sheets by using a stapler or the like. In a case of continuously processing paper sheet bundles by using the above-described sheet stacking device, a subsequent paper sheet cannot be accepted until a paper sheet bundle that has been bound is ejected from the processing tray. As a method of ejecting the paper sheet bundle from the processing tray, there is a known technology in which the paper sheet bundle that has been bound is dropped by its own weight and retracted to a different output tray positioned below.

On the other hand, there is a technology in which an upper tray and a lower tray are provided, the upper tray is moved upward to widen an interval between the upper tray and the lower tray and secure a space in order that a user may easily remove paper sheets stacked on the lower tray.

SUMMARY

In an aspect of the present disclosure, there is provided a sheet stacking device that includes a pair of first sheet stackers, a pair of sheet alignment members, a second sheet stacker, a sheet removal portion, and control circuitry. The pair of first sheet stackers is configured to stack both end portions of a sheet to be ejected, the end portions being end portions of the sheet in a direction orthogonal to an ejecting direction of the sheet. The pair of sheet alignment members is configured to contact both ends of the sheet in the direction orthogonal to the ejecting direction of the sheet to align the sheet on the first sheet stackers. The second sheet stacker is disposed lower than the pair of first sheet stackers and configured to stack the sheet dropped from between the first sheet stackers. The sheet removal portion is disposed on one side in the direction orthogonal to the ejecting direction of the sheet and configured to remove the sheet. The control circuitry is configured to cause one first sheet stacker of the pair of first sheet stackers and one sheet alignment member of the pair of sheet alignment members to move toward an opposite side of the sheet removal portion in the direction orthogonal to the ejecting direction of the sheet after the sheet is dropped from between the pair of first sheet stackers.

In another aspect of the present disclosure, there is provided an image forming system that includes an image forming apparatus and the sheet stacking device. The image forming apparatus is configured to form an image on a sheet. The sheet stacking device is configured to stack the sheet having the image formed by the image forming apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
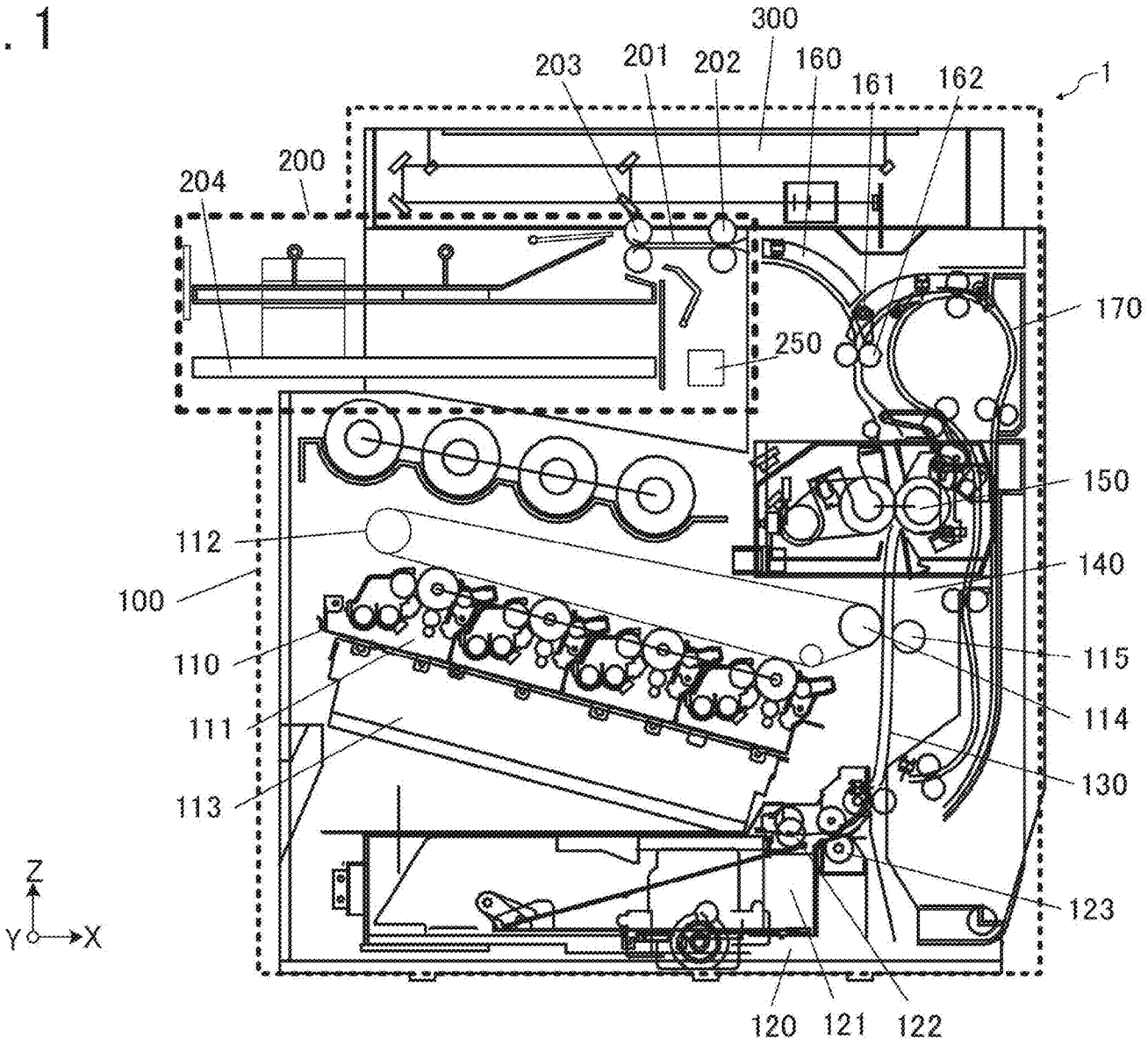
FIG. 1 is a schematic view illustrating an outline of an image forming apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a sheet stacking device, a post-processing apparatus, and an image forming system according to an embodiment will be described with reference to the drawings. In the following description, a paper medium (hereinafter referred to as a paper sheet) is exemplified as a sheet, but a sheet of plastic, cloth, metal, or the like is also applicable.

1. General Arrangement

FIG. 1 is a schematic view illustrating an outline of an image forming apparatus. An image forming system 1 includes: an image forming apparatus 100; a post-processing apparatus 200 including a sheet stacking device; and an image reading apparatus 300.

The image forming apparatus 100 is a tandem image forming unit of an indirect transfer type and capable of forming a color image. The image forming apparatus 100 includes: an image forming device 110 in which image forming stations 111 of four colors are arranged; and an optical writer 113 provided below the image forming device 110 in an adjacent manner. The image forming apparatus 100 includes: a sheet feeder 120 provided below the image forming device 110; and a sheet feeding conveyance path 130 that guides a paper sheet picked up at the sheet feeder 120 in order to convey the paper sheet to a secondary transfer device 140 and a fixing device 150. The image forming apparatus 100 includes: a sheet ejection path 160 that guides a paper sheet having an image fixed in order to convey the paper sheet to the post-processing apparatus 200; and a duplex conveyance path 170 that reverses and guides a paper sheet having one surface formed with an image in order to form an image on the other surface of the paper sheet.

The image forming stations 111 of the image forming device 110 include photoconductor drums for the respective colors (yellow, magenta, cyan, and black (YMCK)), and each of the image forming stations further includes a charging unit, a developing unit, a primary transfer unit, a cleaning unit, and a discharging unit which are arranged along an outer periphery of each photoconductor drum. The image forming device 110 includes: an intermediate transfer belt 112 onto which images on the respective photoconductor drums are transferred by the respective primary transfer units; and the optical writer 113 that writes, per color, the image on each of the photoconductor drums. The optical writer 113 is disposed below the image forming stations 111, and the intermediate transfer belt 112 is disposed above the image forming stations 111. The intermediate transfer belt 112 is rotatably supported by a plurality of support rollers. One support roller 114 out of the plurality of the support rollers faces a secondary transfer roller 115 at the secondary transfer device 140 while interposing the intermediate transfer belt 112 so that the image on the intermediate transfer belt 112 can be secondarily transferred onto a paper sheet. Note that a known process may also be employed as such an image forming process.

The sheet feeder 120 includes a sheet feeding tray 121, a pickup roller 122, and a sheet feeding conveyance roller 123. The sheet feeder 120 picks up a paper sheet from the sheet feeding tray 121 and sends the paper sheet upward along the sheet feeding conveyance path 130. This sent paper sheet has an image transferred by the secondary transfer device 140 and is further sent to the fixing device 150. The fixing device 150 includes a fixing roller and a pressure roller, and heating and pressurizing are applied in a course of the paper sheet passing through a nip between the fixing roller and the pressure roller. Thus, toner is fixed on the paper sheet.

The sheet ejection path 160 and the duplex conveyance path 170 are provided downstream of the fixing device 150. These two paths are bifurcated in two directions by a bifurcating claw 161. Thus, a conveyance path is selected between a case of conveyance to the post-processing apparatus 200 side and a case of conveyance to the duplex conveyance path 170. Note that a bifurcating conveyance roller 162 is provided immediately next to the bifurcating claw 161 on an upstream side in a sheet conveyance direction, and applies conveyance force to a paper sheet.

The post-processing apparatus 200 applies predetermined processing (for example, aligning and binding) to a paper sheet conveyed from the image forming apparatus 100 and having an image formed. Additionally, the post-processing apparatus 200 stacks the paper sheet in the output tray 204 (second sheet stacker) positioned most downstream. The details of the post-processing apparatus 200 will be described later. Note that in a case of including the image reading apparatus 300 as illustrated in FIG. 1, the post-processing apparatus 200 is formed between the image forming apparatus 100 and the image reading apparatus 300, and mounted in a space formed in a housing of the image forming apparatus 100 and originally used as a paper sheet ejecting destination. Thus, the space can be effectively used, and space-saving can be promoted.

The post-processing apparatus 200 includes a controller 250. The controller 250 includes a substrate including, for example, a central processor, a main storage device, an auxiliary storage device, and the like, and includes a unit that operates each hardware by software processing. The controller 250 receives a detection signal indicating presence or absence of a paper sheet from a sensor installed in each conveyance path, controls conveyance of the paper sheet in the post-processing apparatus 200 based on the detection signal, and further controls operation of respective units described later. Note that a controller provided in the image forming apparatus 100 may also integrally control the respective units in the post-processing apparatus 200. The image reading apparatus 300 optically scans a document set on a contact glass to read an image on a document surface.

The image reading apparatus 300 may employ a known configuration and a known function.

The image forming apparatus 100 configured as described above generates image data to be used for writing based on document data read from the image reading apparatus 300 or print data transferred from an external personal computer and the like. Then, the optical writer 113 performs optical writing on the respective photoconductor drums based on the image data, and the images of the respective colors formed at the respective image forming stations 111 are sequentially transferred onto the intermediate transfer belt 112. Thus, a color image obtained by superimposing the images of the four colors is formed on the intermediate transfer belt 112. On the other hand, a paper sheet is fed from the sheet feeding tray 121 in accordance with the image formation. The paper sheet is temporarily stopped at a position of a registration roller immediately before the secondary transfer device 140 and sent out synchronously with timing of a leading end of the image on the intermediate transfer belt 112. The image is secondarily transferred onto the paper sheet at the secondary transfer device 140, and the paper sheet is sent to the fixing device 150.

In a case of performing single-sided printing and in a case after completing duplex printing in the duplex printing, a paper sheet having the image fixed by the fixing device 150 is conveyed to the sheet ejection path 160 side by the switching operation of the bifurcating claw 161. In a case after completing printing of one surface in the duplex printing, the paper sheet is conveyed to the duplex conveyance path 170 side by the switching operation of the bifurcating claw 161. The paper sheet conveyed to the duplex conveyance path 170 is reversed, and sent again to the secondary transfer device 140 to form an image on the other side, and then conveyed to the sheet ejection path 160. The paper sheet conveyed to the sheet ejection path 160 is then conveyed to the post-processing apparatus 200. Either after the predetermined processing, such as the binding, is applied at the post-processing apparatus 200 or without any processing, the paper sheet is ejected to the output tray 204.

2. Post-Processing Apparatus

Figure 2A:
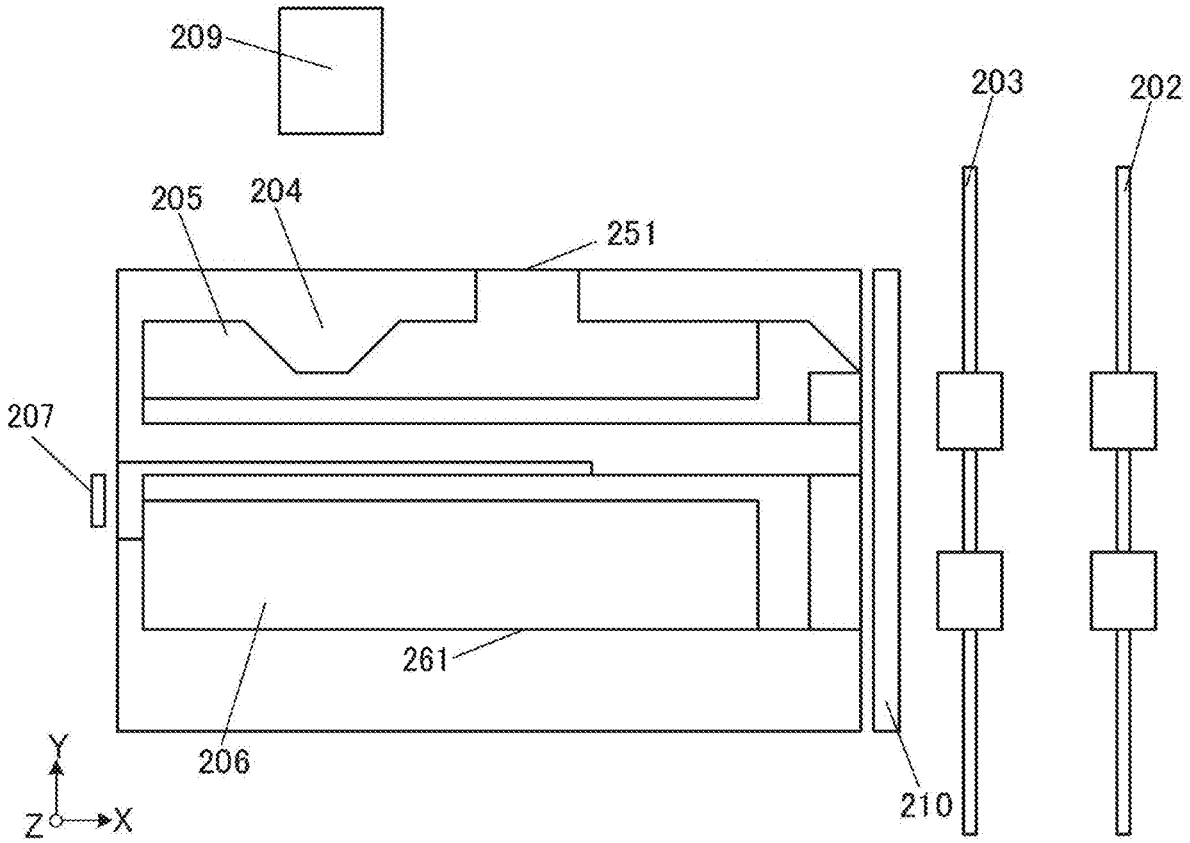
FIG. 2A is a top view of a post-processing apparatus.
Figure 2B:
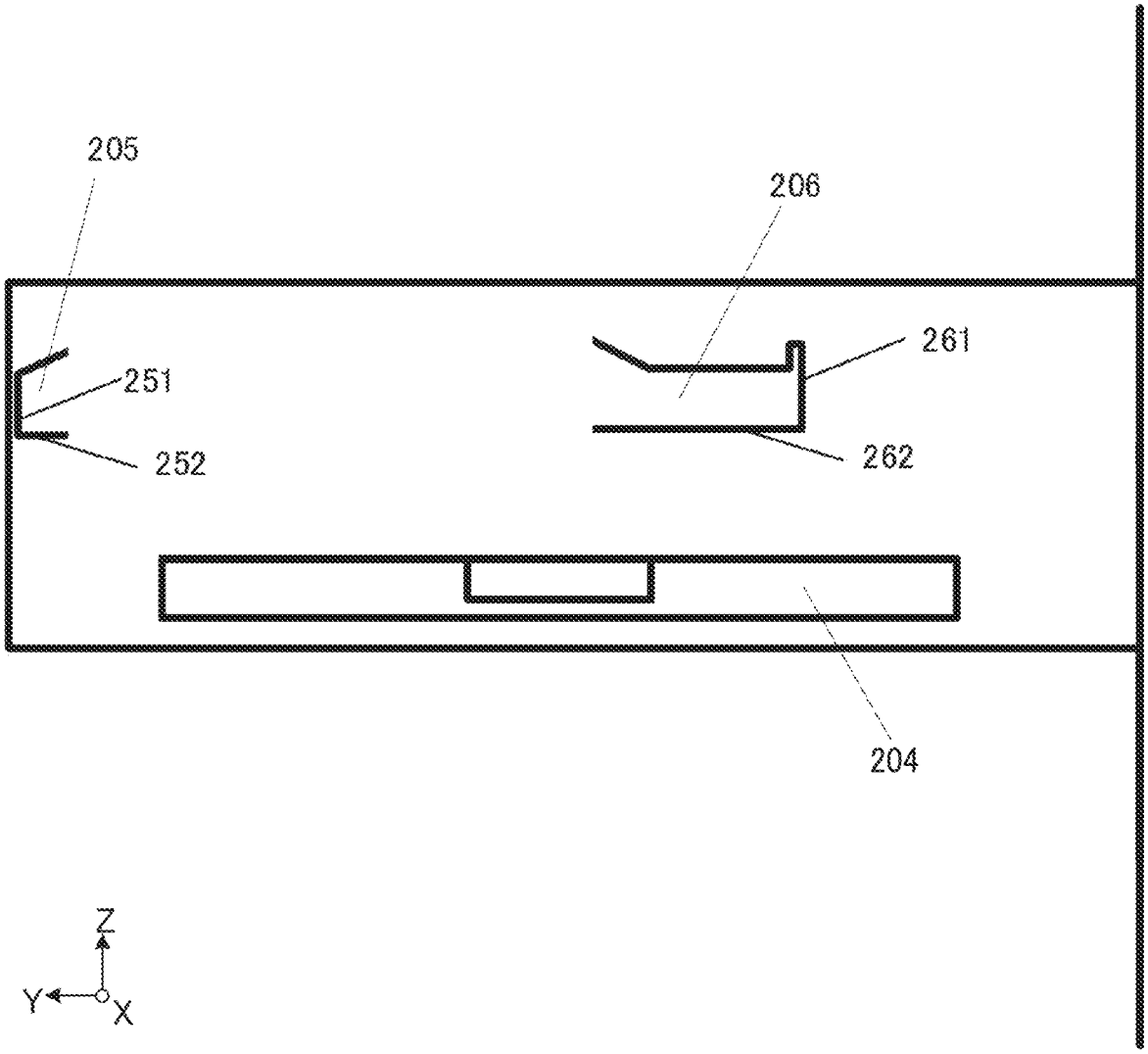
FIG. 2B is a rear side view of the post-processing apparatus.
Figure 3:
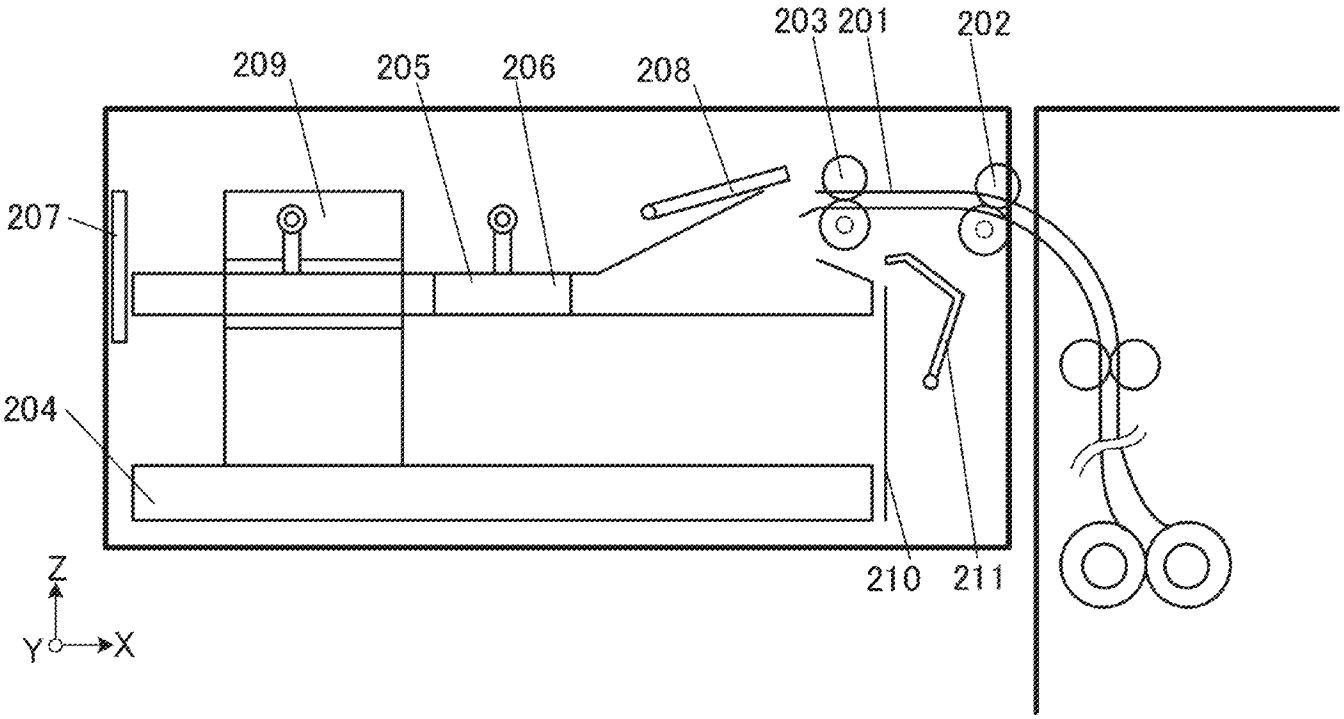
FIG. 3 is a side view of the post-processing apparatus.

FIG. 2A is a top view illustrating a schematic configuration of the post-processing apparatus 200, and FIG. 2B is a side view (hereinafter, referred to as a rear side view) illustrating the schematic configuration of the post-processing apparatus 200 in a case where the post-processing apparatus 200 is visually checked from a leading end stopper 207 side. FIG. 3 is a side view of the post-processing apparatus 200. FIGS. 2A, 2B, and 3 illustrate a basic configuration applied to each embodiment described below.

The post-processing apparatus 200 includes, from the upstream side in the sheet conveyance direction, an entrance roller pair 202, a paper surface detection sensor 211 (see FIG. 3), a tail end reference fence 210, an output roller pair 203, and a pair of jogger fences 205 and 206 on a far side and a near side, a tail end guide 208 (see FIG. 3), a staple unit 209, and the leading end stopper 207. The post-processing apparatus 200 further includes the output tray 204 below these respective units. As illustrated in FIG. 2B, the jogger fence 206 includes a sheet stacker 262 as a first sheet stacking unit and a sheet alignment member 261 as a sheet alignment device. The sheet stacker 262 is a part that stacks conveyed sheets while supporting the sheets from a lower side. The sheet alignment member 261 is a part that aligns the conveyed sheets from a side. Similarly, the jogger fence 205 also includes: a sheet stacker 252 as the first sheet stacking unit; and a sheet alignment member 251 as the sheet alignment device. Here, the jogger fences 205 and 206, in each of which the sheet stacker and the sheet alignment member are integrally formed, are exemplified. However, not limited thereto, the sheet stacker and the sheet alignment member may be independently moved as separate bodies.

The post-processing apparatus 200 includes a sheet receiver including a guide plate 201 that receives a paper sheet from the sheet ejection path of the image forming apparatus 100. The guide plate 201 includes the entrance roller pair 202 in the most upstream side in the sheet conveyance direction. The guide plate 201 includes, in the most downstream side in the sheet conveyance direction, the output roller pair 203 having a sheet ejecting function. The entrance roller pair 202 and the output roller pair 203 are rotated by an entrance motor to convey a paper sheet along the guide plate 201.

The sheet ejection operation is different between a shift mode and a staple mode. In the shift mode, a paper sheet is shifted and ejected (also referred to as a straight sheet ejection mode because the paper sheet is ejected as it is). In the staple mode, a plurality of paper sheets is bound and then ejected. Here, the respective modes as well as configurations of respective components will be described.

2.1 Shift Mode

Figure 4:
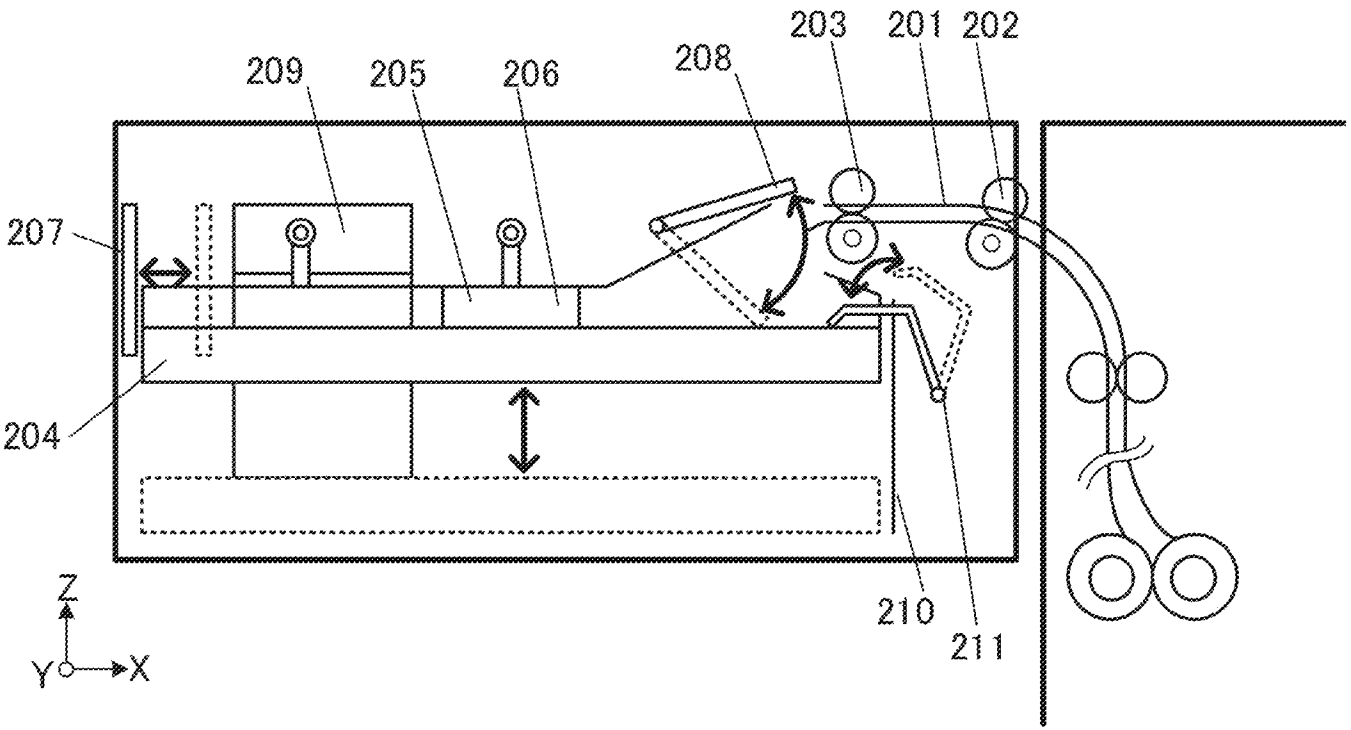
FIG. 4 is a side view of the post-processing apparatus to describe a shift mode.

The shift mode will be described using FIGS. 4 to 6. FIG. 4 is a side view and FIG. is a top view of the post-processing apparatus 200 to describe the operation during the shift mode. FIG. 6 is a flowchart illustrating exemplary operation during the shift mode.

The shift mode is a mode in which a sheet ejecting position of a paper sheet is shifted in a direction intersecting with the sheet conveyance direction (depth direction in FIG. 4) per predetermined number of sheets at the time of ejecting paper sheets, and the paper sheets are sorted by this shift.

In the shift mode, the output roller pair 203 provided at a most downstream end portion of the guide plate 201 is driven to reciprocate in a direction perpendicular to the sheet conveyance direction (depth direction in FIG. 4) by a shift motor. In other words, the output roller pair 203 is moved in a direction different from the sheet conveyance direction per the predetermined number of sheets at the time of sorting the paper sheets in the shift mode. With the movement of the output roller pair 203, a paper sheet is ejected to a position shifted from a previous position on the output tray 204. Thus, when the paper sheets ejected from the post-processing apparatus 200 are stacked on the output tray 204, the ejecting position is alternately shifted per the predetermined number of sheets to perform sorting of the paper sheets. Note that a known mechanism may also be employed as a shift mechanism that performs the shifting.

Next, the operation in the shift mode will be described using the flowchart of FIG. 6. Note that the flowchart of FIG. 6 and flowcharts illustrated later in respective drawings are implemented by operation of the respective units based on control signals from the controller 250.

Figure 5:
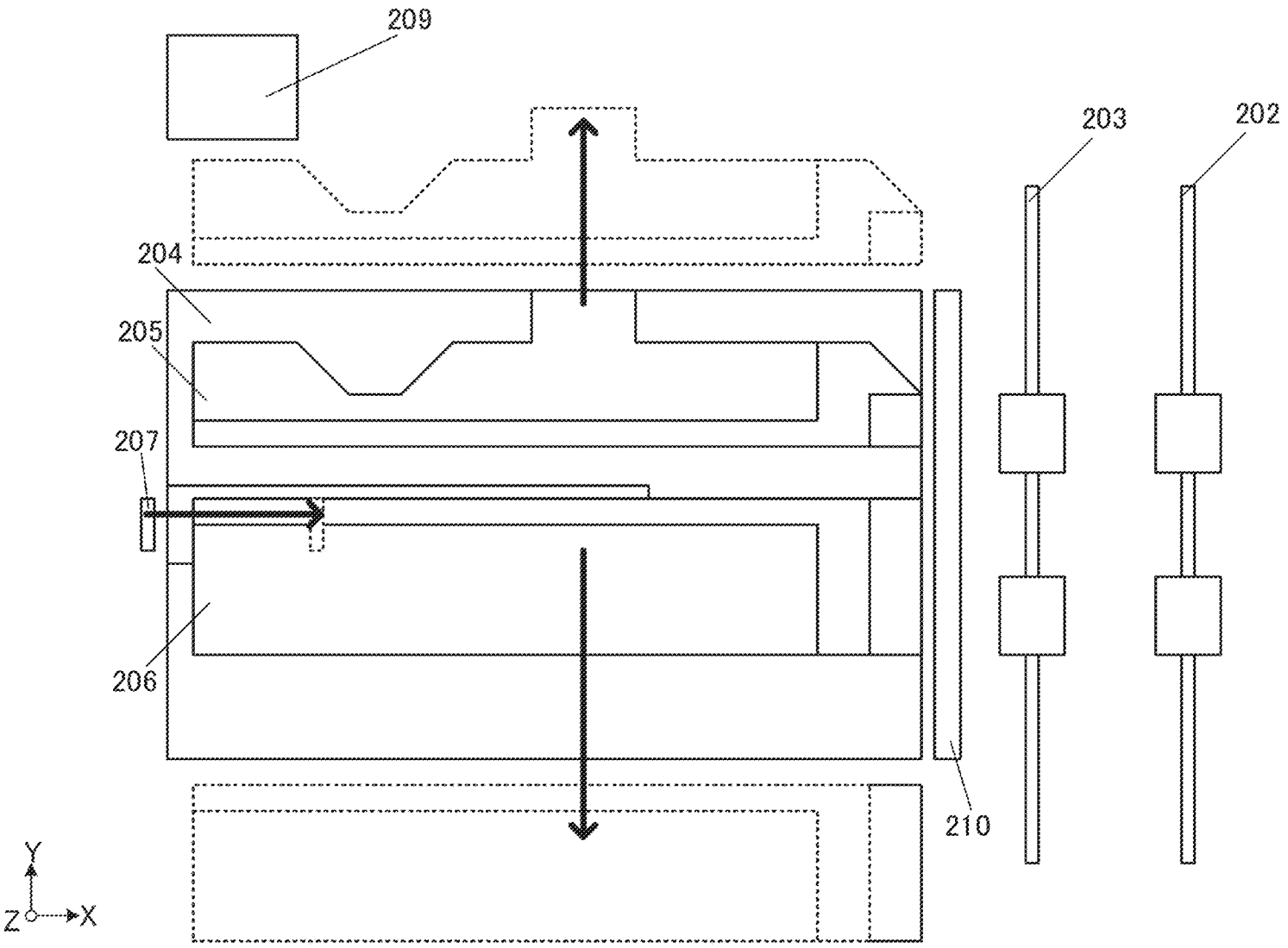
FIG. 5 is a top view of the post-processing apparatus to describe the shift mode.
Figure 6:
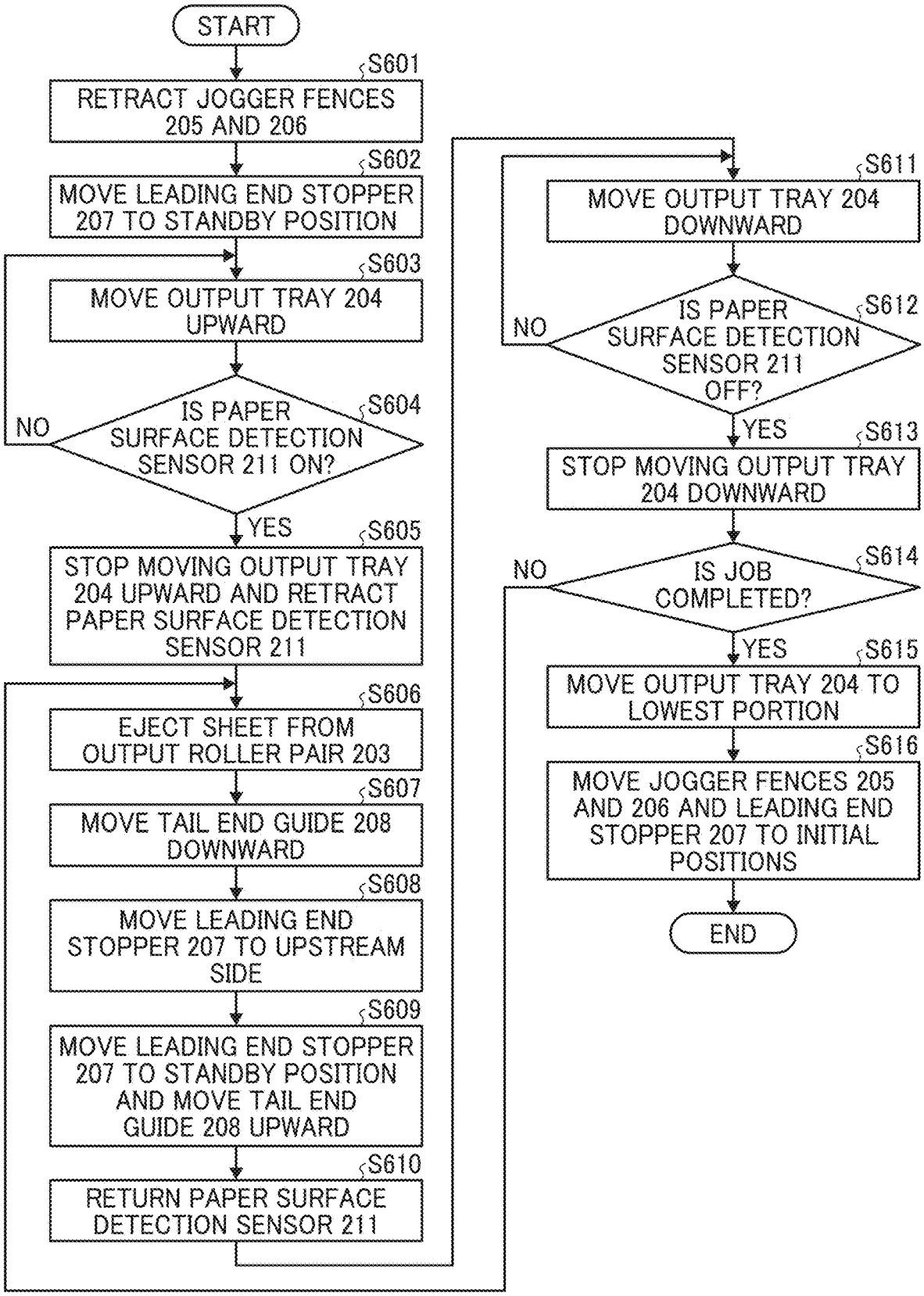
FIG. 6 is a flowchart illustrating exemplary operation in the shift mode.

As illustrated in FIGS. 4 and 5, the jogger fences 205 and 206 first receive power from a jogger fence moving motor, and each of the jogger fences 205 and 206 is retracted in an outer side direction (in a direction in which the jogger fences 205 and 206 are separated from each other) up to each of standby positions in a space above the output tray 204 (S601). The directions in which the jogger fences 205 and 206 are moved to the respective standby positions are different from the sheet conveyance direction and correspond to the direction intersecting with the sheet conveyance direction. After the jogger fences 205 and 206 are moved to the respective standby positions, the leading end stopper 207 receives power from a leading end stopper drive motor, and is moved to a prescribed standby position (S602). Then, the output tray 204 receives power from an output tray elevation motor to be moved upward (S603). When the paper surface detection sensor 211 detects that the output tray 204 is moved upward to the positions of the jogger fences 205 and 206 (S604: YES), the upward movement of the output tray 204 is stopped, and the paper surface detection sensor 211 is retracted into the tail end reference fence 210 (S605). In a case where a height of the output tray 204 is lower than heights of the jogger fences 205 and 206, the paper surface detection sensor 211 is turned OFF. In a case where the height of the output tray 204 is higher than the heights of the jogger fences 205 and 206, the paper surface detection sensor 211 is turned ON. The height of the output tray 204 is detected by the ON/OFF switching of this paper surface detection sensor 211.

After completion of the movement of the respective units, a paper sheet is ejected to the output tray 204 from the output roller pair 203 (S606), and the tail end guide 208 that has been waiting above is moved downward toward the output tray 204 at the timing when a tail end of the paper sheet passes through the output roller pair 203 (S607). With this operation, it is possible to prevent a subsequent paper sheet from being ejected and causing paper jam in a state in which the tail end of the paper sheet is not dropped from the output roller pair 203.

After the tail end guide 208 is moved downward, the leading end stopper 207 is moved from the standby position to the upstream side in the conveyance direction (S608). Then, the paper sheet is interposed between the leading end stopper 207 and the tail end reference fence 210. Thus, position alignment of the paper sheet is performed. After completion of the position alignment, the leading end stopper 207 and the tail end guide 208 are again moved to the respective standby positions (S609).

Furthermore, after completion of the position alignment, the paper surface detection sensor 211 is returned from the retracted position (S610) and detects the height of the output tray 204. Thus, the output tray 204 is moved downward by a thickness of stacked paper sheets (S611 to S613). As a result, a distance from a nip of the output roller pair 203 to an uppermost paper sheet on the output tray 204 is kept constant. Therefore, a large number of sheets can be stacked. After completion of the downward movement of the output tray 204, the paper surface detection sensor 211 is moved to the retracted position. Note that the downward moving operation of the output tray 204 may be performed not per sheet but per a plurality of sheets.

In a case where all of print jobs are not completed (S614: NO), processing is returned to S606. When all of the print jobs are completed (S614: YES), the output tray 204 is moved downward to an initial position in a lowest portion (S615), and the jogger fences 205 and 206 and the leading end stopper 207 are also moved to respective initial positions (S616).

2.2 Staple Mode

Figure 7:
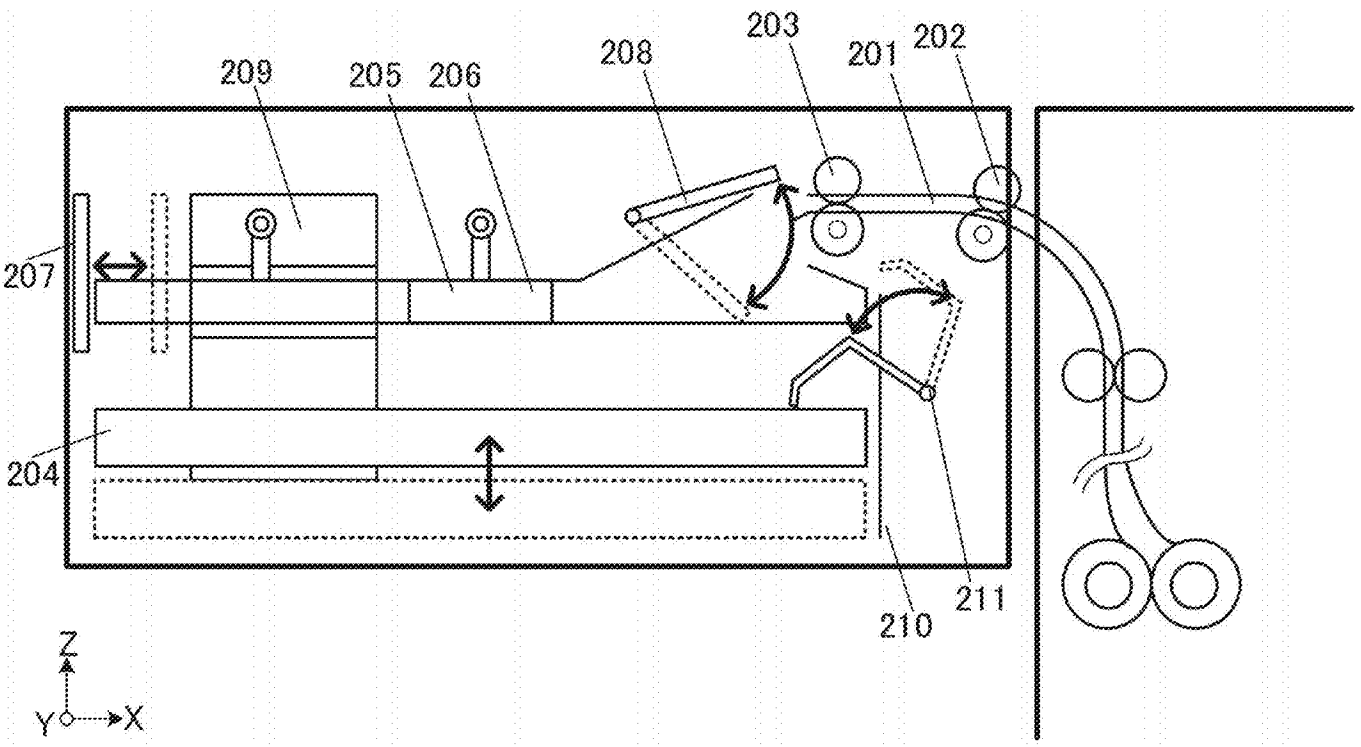
FIG. 7 is a side view of the post-processing apparatus to describe a staple mode.

The staple mode will be described using FIGS. 7 to 12. FIG. 7 is a side view of the post-processing apparatus 200 to describe the staple mode, and FIGS. 8 to 11 are top views illustrating respective transition states during the staple mode. Additionally, FIG. 12 is a flowchart illustrating exemplary operation during the staple mode. In the following, the description will be provided along the flowchart of FIG. 12.

The staple mode is a mode in which paper sheets are bound by a stapler per the predetermined number of sheets and then ejected at the time of ejecting the paper sheets.

Figure 8:
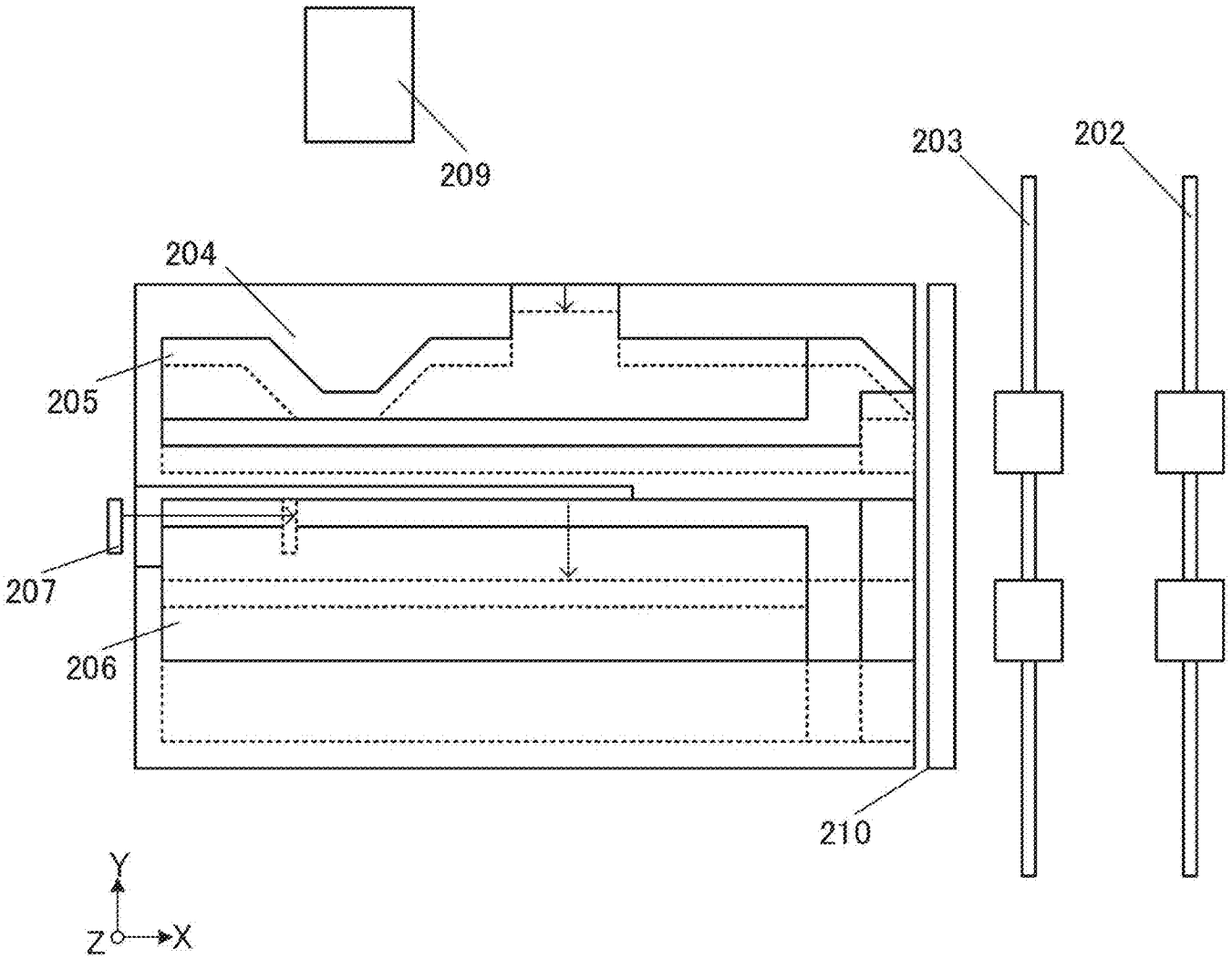
FIG. 8 is a top view illustrating a transition state of the post-processing apparatus during the staple mode.

During the staple mode, as illustrated in FIGS. 7 and 8, the output tray 204, the jogger fences 205 and 206, and the leading end stopper 207 are first moved to prescribed sheet receiving positions respectively, and the staple unit 209 is also moved to a prescribed staple position (S1201 in FIG. 12). Note that the sheet receiving position of the output tray 204 is located about 30 mm below from bottom surfaces of the jogger fences 205 and 206. Each of the sheet receiving positions of the jogger fences 205 and 206 is located 7 mm on an outer side from a width of a paper sheet to be ejected. The sheet receiving position of the leading end stopper 207 is a position retracted from the tail end reference fence 210 to the downstream side by a length obtained by adding about 25 mm to a length of a paper sheet to be ejected.

When the movement of the output tray 204 is finished, the paper surface detection sensor 211 is retracted into the tail end reference fence 210 (S1202). In the staple mode, in a case where a distance from each of the bottom surfaces of the jogger fences 205 and 206 becomes 30 mm or less, the paper surface detection sensor 211 is turned ON, and in a case where the distance becomes larger than 30 mm, the paper surface detection sensor 211 is turned OFF. Therefore, the height detection can be enabled by the ON/OFF switching.

After completion of the movement of the respective units, the paper sheet is ejected to the output tray 204 from the output roller pair 203 (S1203), and the tail end guide 208 that has been waiting above is moved downward to the output tray 204 at the timing when a tail end of the paper sheet passes through the output roller pair 203 (S1204). With this operation, it is possible to prevent a subsequent paper sheet from being ejected and causing paper jam in the state in which the tail end of the paper sheet is not dropped down from the output roller pair 203.

Figure 9:
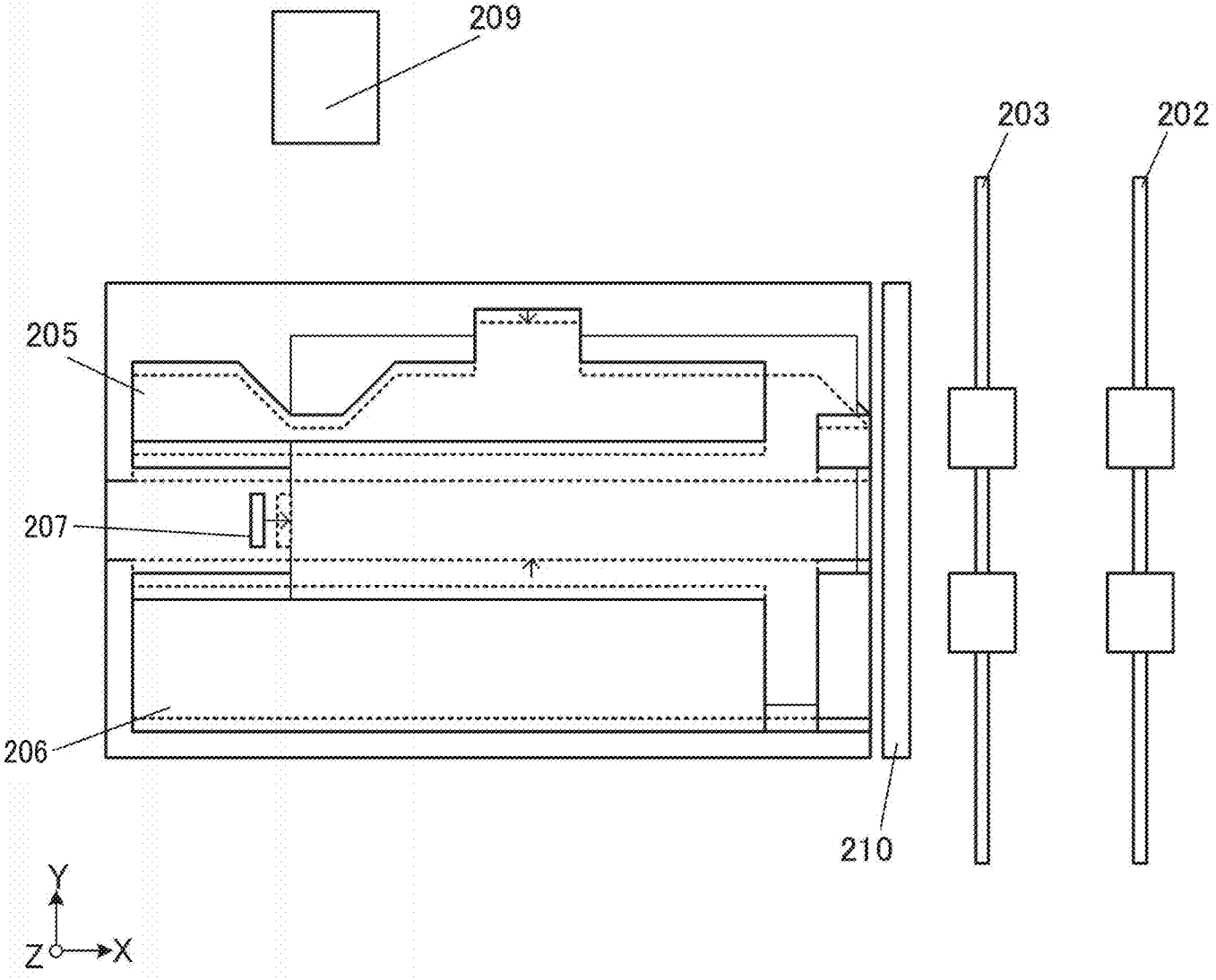
FIG. 9 is a top view illustrating a transition state of the post-processing apparatus during the staple mode.
Figure 10:
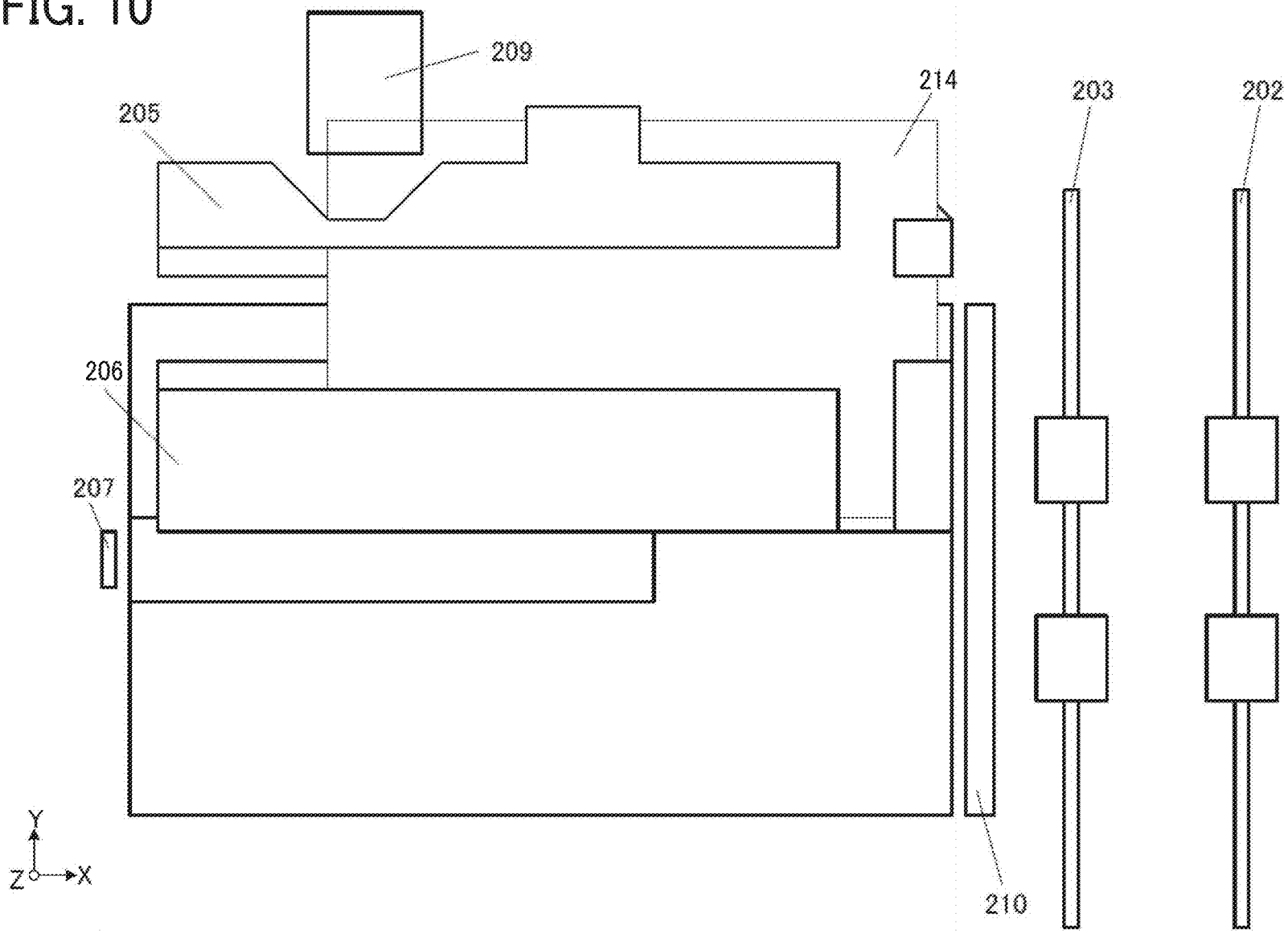
FIG. 10 is a top view illustrating a transition state of the post-processing apparatus during the staple mode.

After the tail end guide 208 is moved downward, the leading end stopper 207 is moved in a direction to the paper sheet as illustrated in FIG. 9 so that the jogger fences 205 and 206 are located close to each other to interpose the paper sheet. Thus, the position alignment of the paper sheet is performed (S1205). After completion of the position alignment, the jogger fences 205 and 206, the leading end stopper 207, and the tail end guide 208 are moved again to the respective sheet receiving positions (S1206).

The above-described position alignment operation is repeated from a first sheet to a final sheet (S1207: a loop of NO). When the position alignment for the final sheet is completed (S1207: YES), the leading end stopper 207 is retracted from between the jogger fences 205 and 206 (S1208). Then, the jogger fences 205 and 206 move a paper sheet bundle to an installation position of the staple unit 209 while relatively keeping the interposing position in the width direction (see FIG. 10).

After the jogger fences 205 and 206 are moved to the installation position of the staple, the staple unit 209 binds the paper sheet bundle (S1210).

Figure 11:
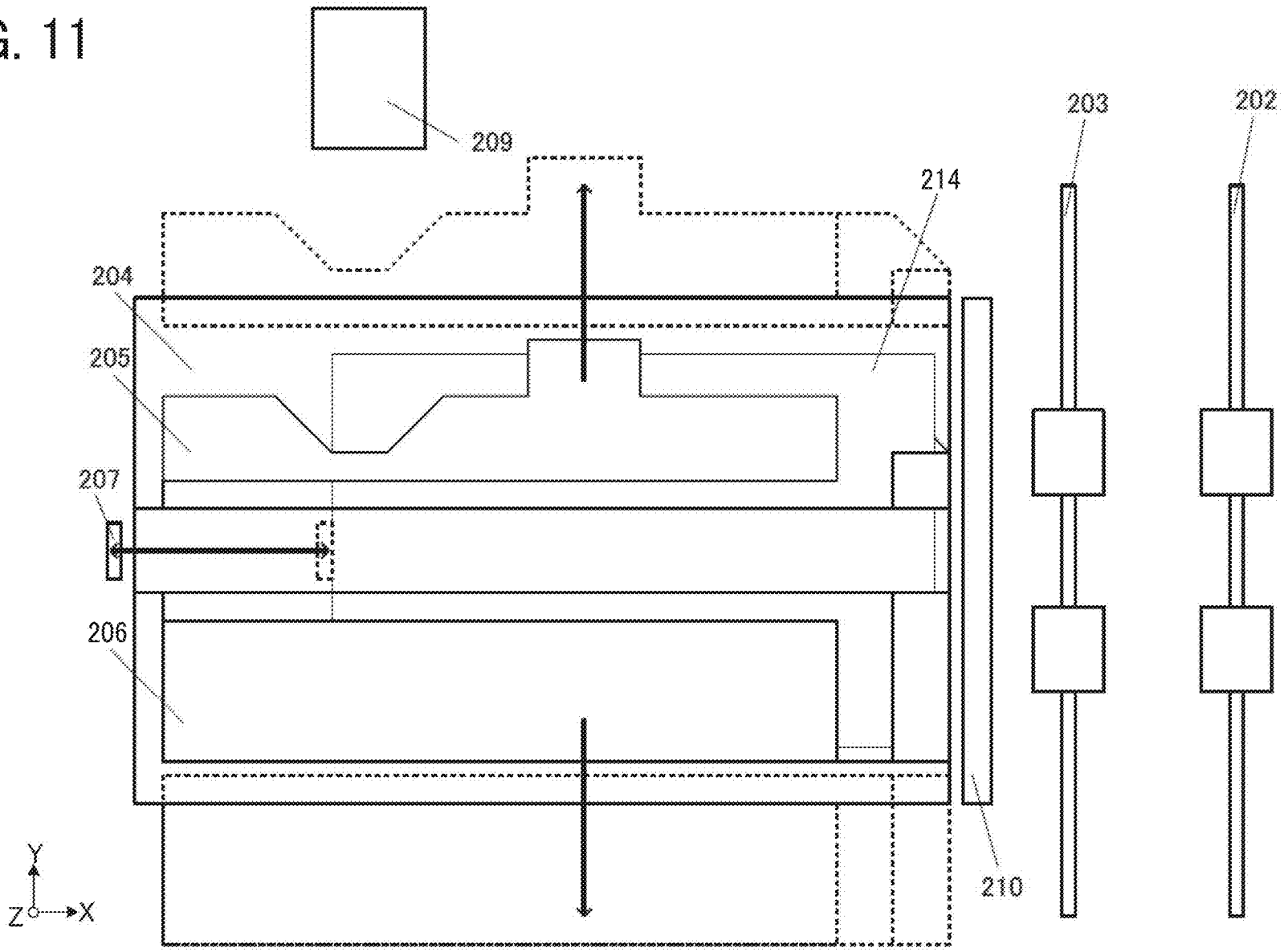
FIG. 11 is a top view illustrating a transition state of the post-processing apparatus during the staple mode.
Figure 12:
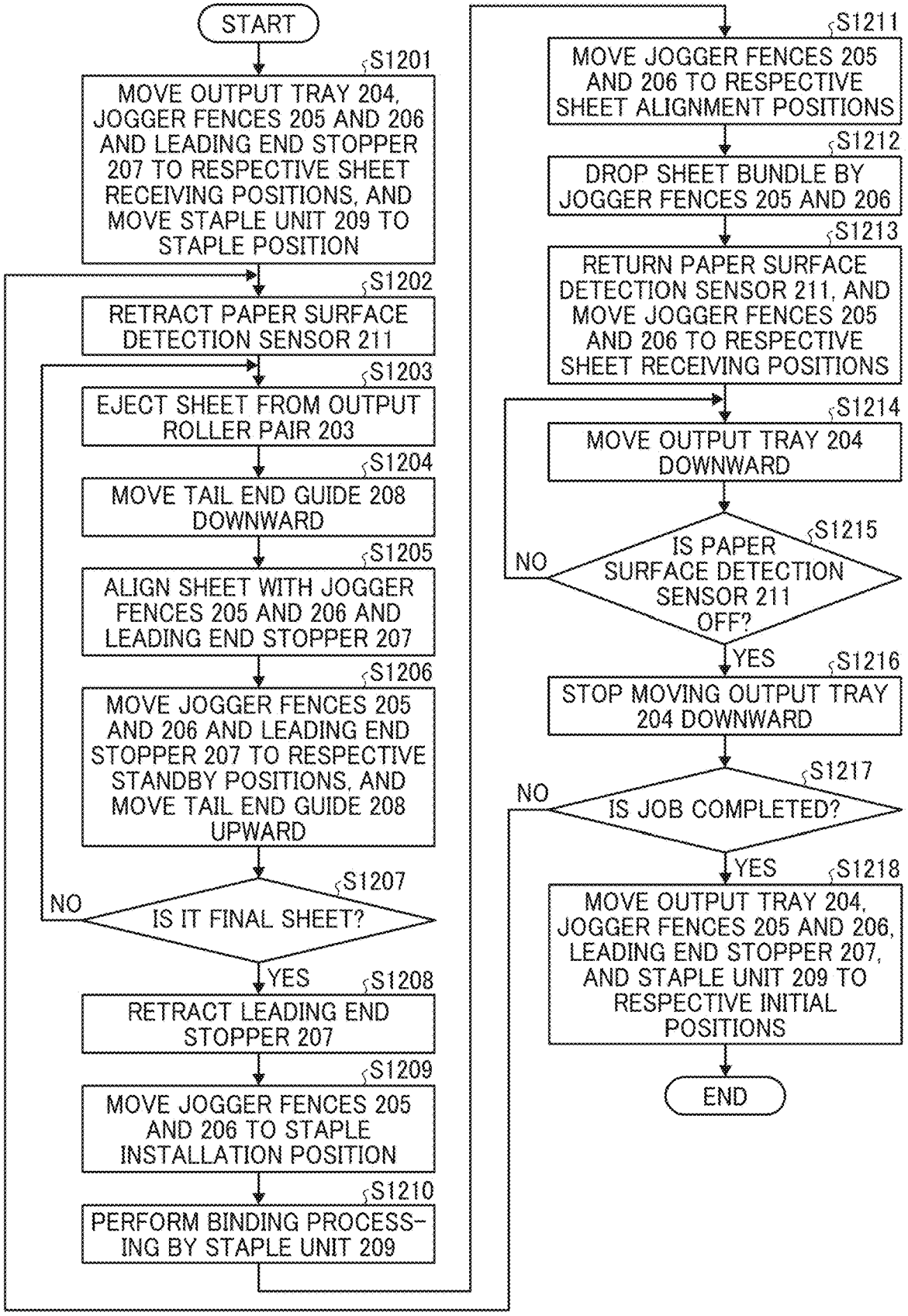
FIG. 12 is a flowchart illustrating exemplary operation in the staple mode.

After completion of the binding by the staple unit 209, the jogger fences 205 and 206 are moved to the respective positions where the position alignment in the width direction of the paper sheet has been performed as illustrated in FIG. 11 (S1211). Then, the leading end stopper 207 is also moved to the position where the position alignment in the sheet conveyance direction has been performed. After completion of the movement of the jogger fences 205 and 206 and the leading end stopper 207, the jogger fences 205 and 206 are moved outward in order to drop the paper sheet bundle by its own weight to the output tray 204 positioned below the jogger fences 205 and 206 (S1212). After the paper sheet bundle is dropped, the jogger fences 205 and 206 and the leading end stopper 207 are moved to the above-described respective sheet receiving positions. Additionally, after the paper sheet bundle is dropped from between the jogger fences 205 and 206, the paper surface detection sensor 211 is returned from the retracted position (S1213).

Since the paper surface detection sensor 211 detects the height, the output tray 204 is moved downward by the thickness of the stacked paper sheet bundle (S1214 to S1216). Thus, the distance from each of the bottom surfaces of the jogger fences 205 and 206 to the uppermost paper sheet on the output tray 204 is kept constant. Therefore, a large number of sheets can be stacked.

In a case where all of print jobs are not completed (S1217: NO), the processing is returned to S1202. When all of the print jobs are completed (S1217: YES), the output tray 204 is moved downward to the lowest portion (initial position), and other units are also moved to the prescribed initial positions, respectively (S1218).

Aspects of Embodiment

In the above basic configuration, a user removes a paper sheet bundle stacked on the output tray 204. The mechanisms such as the jogger fence 206 and the leading end stopper 207 are provided above the output tray 204. Therefore, in a case where the mechanisms are positioned at any of the sheet receiving positions, the standby positions, and the initial positions, the mechanisms may become obstacles at the time of removing the paper sheet bundle. In the following, the description will be provided for aspects in which a paper sheet bundle stacked on the output tray 204 can be easily removed. In the following description, note that the sheet receiving positions, the standby positions, and the initial positions are collectively referred to as "standby positions".

Figure 13A:
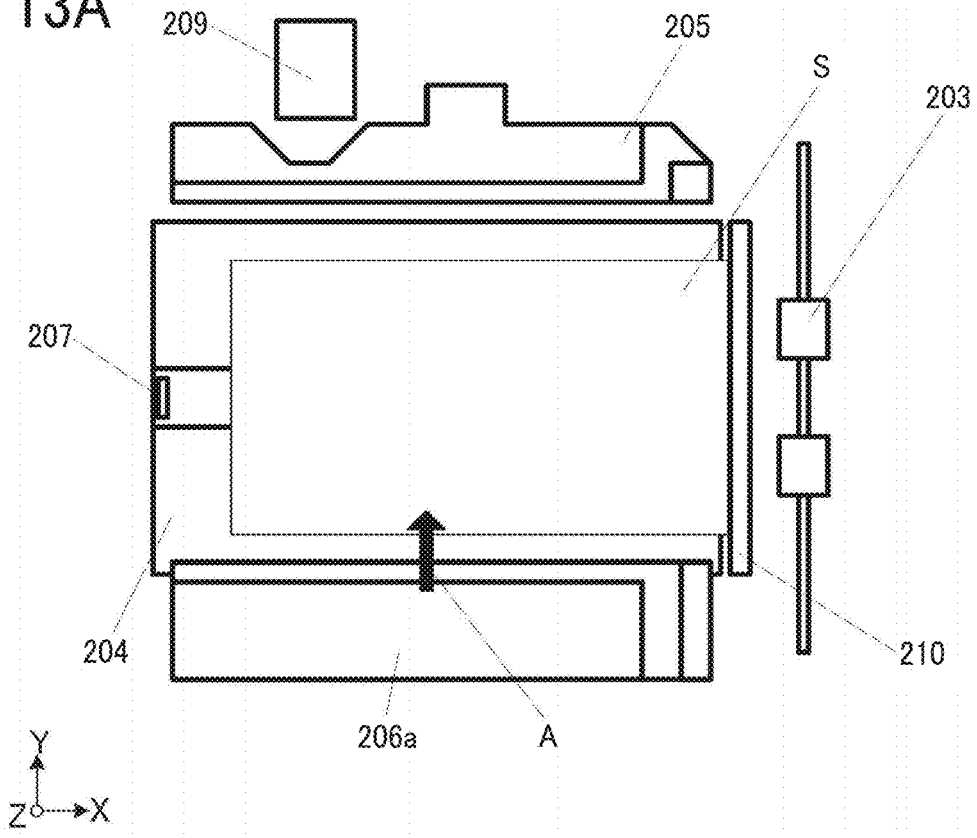
FIGS. 13A and 13B are top views illustrating the post-processing apparatus according to an embodiment and also the views to describe an aspect in which a jogger fence is moved after a paper sheet bundle is dropped.
Figure 13B:
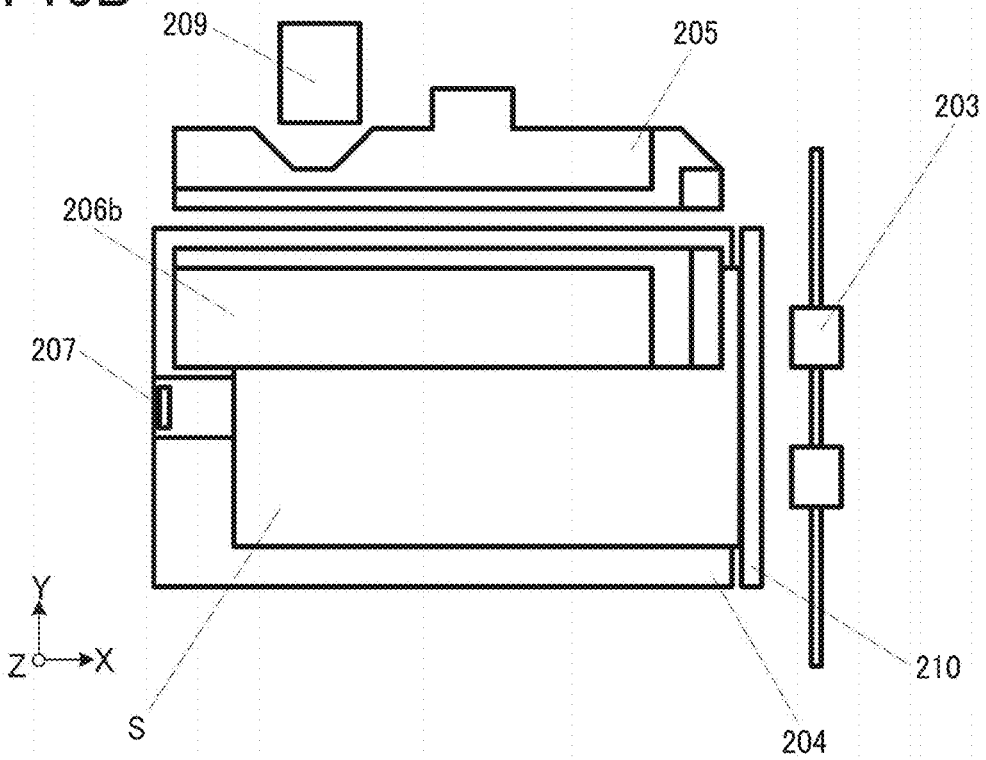
Figure 14:
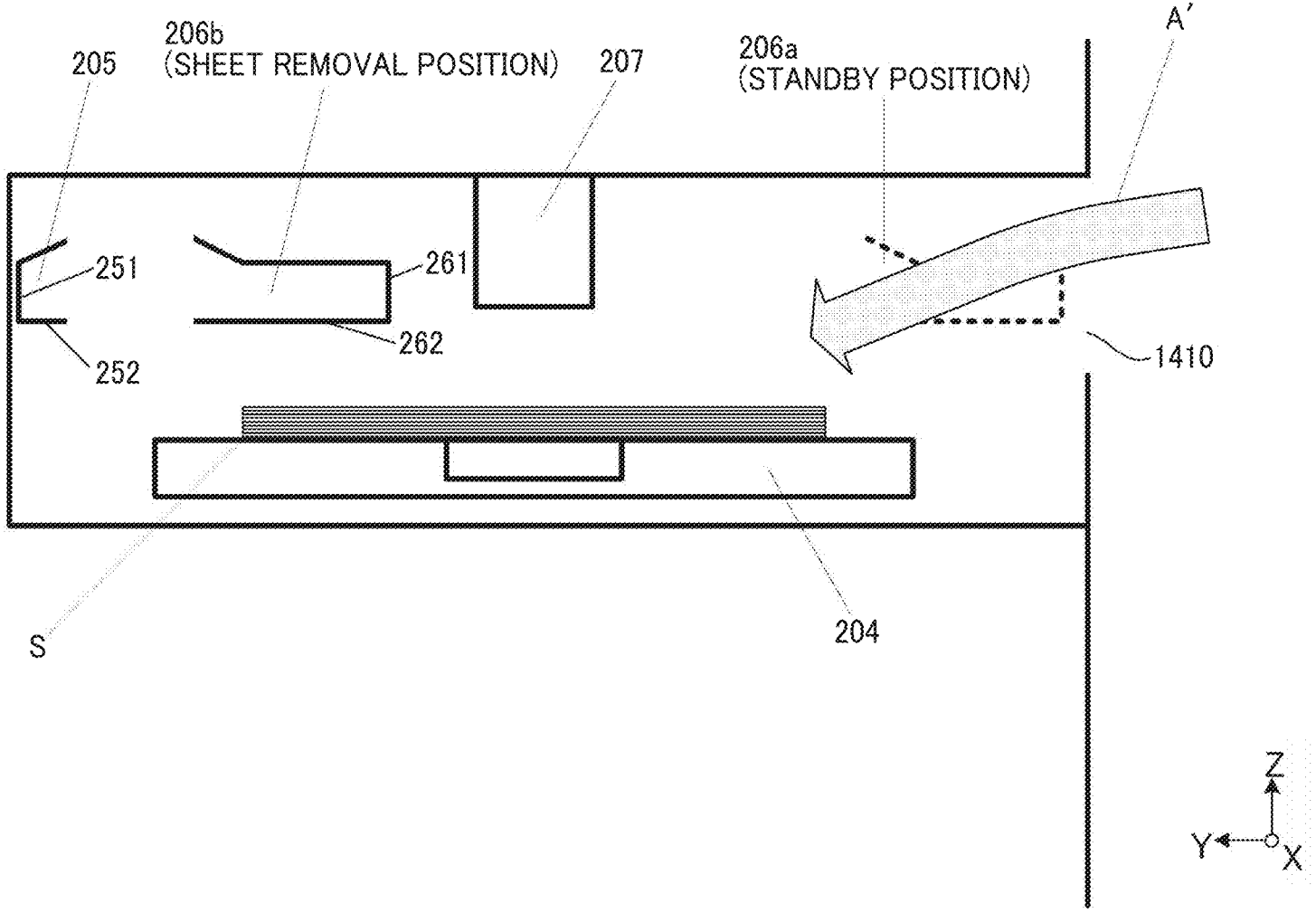
FIG. 14 is a rear side view illustrating the post-processing apparatus according to the embodiment and also the view to describe the aspect in which the jogger fence is moved after the paper sheet bundle is dropped.
Figure 15:
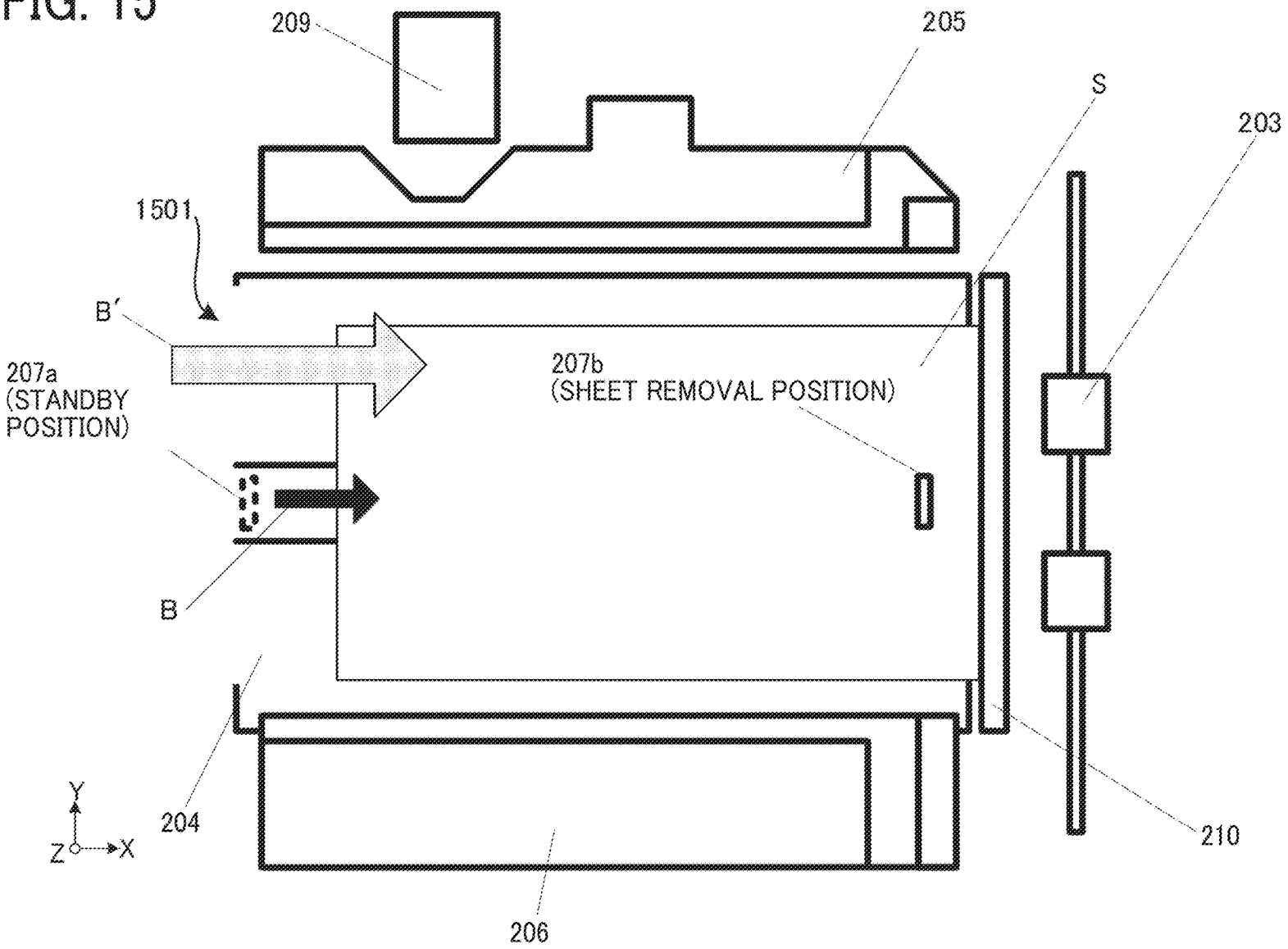
FIG. 15 is a top view illustrating the post-processing apparatus according to the embodiment and also the view to describe an aspect in which a leading end stopper is moved after the paper sheet bundle is dropped.
Figure 16:
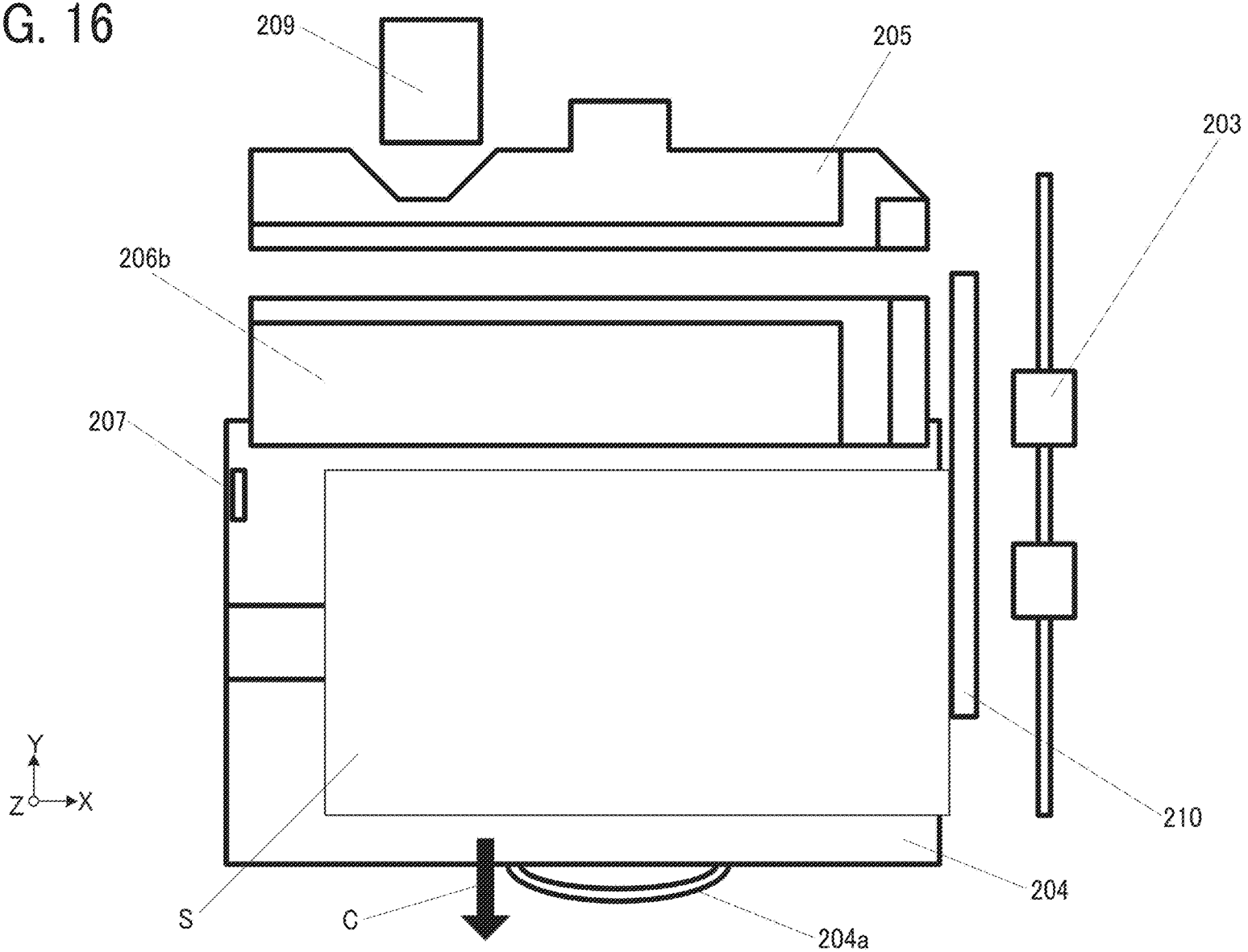
FIG. 16 is a top view illustrating the post-processing apparatus according to the embodiment and also the view to describe an aspect in which an output tray is pulled out by using a grip portion.
Figure 17:
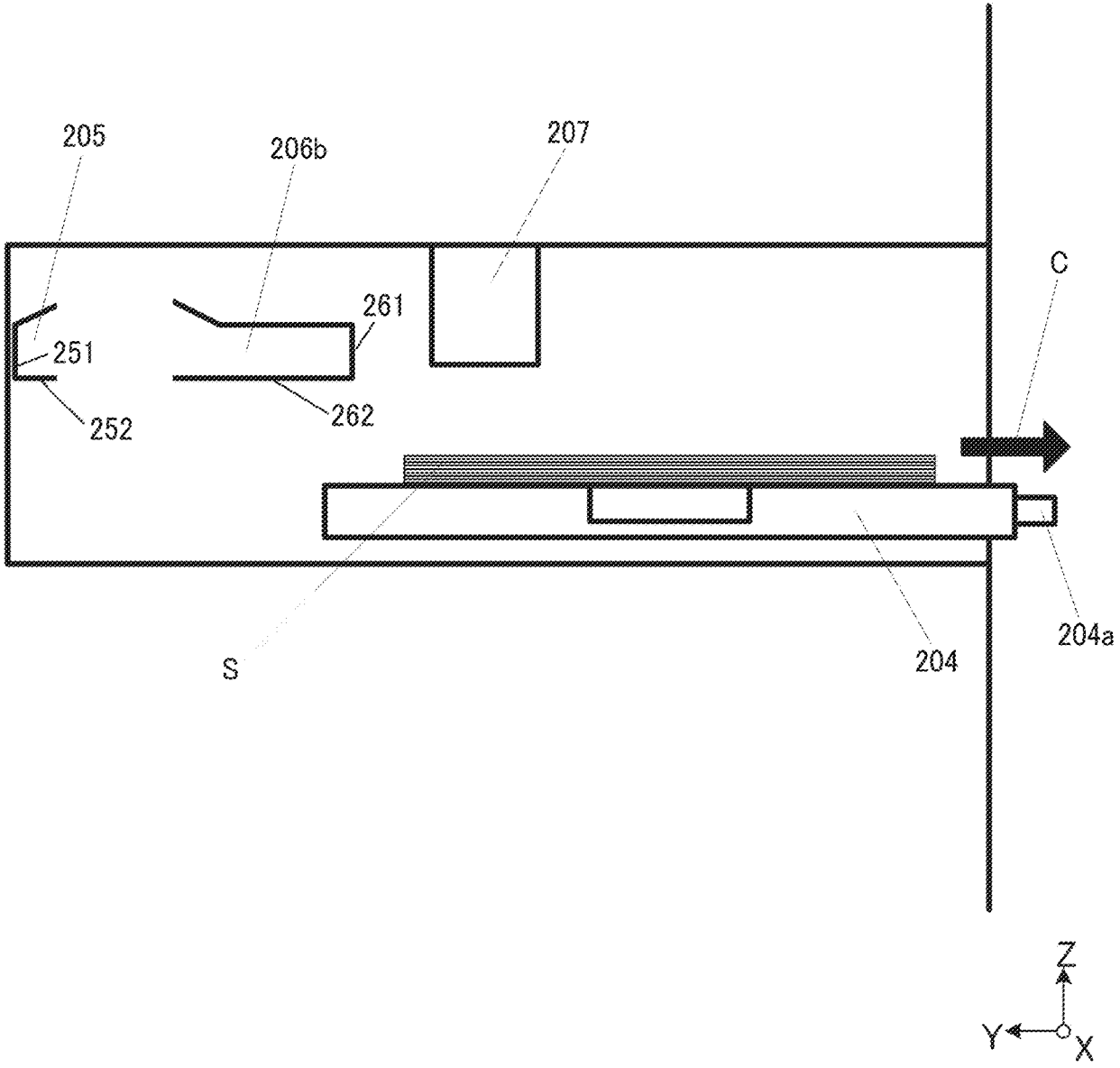
FIG. 17 is a rear side view illustrating the post-processing apparatus according to the embodiment and also the view to describe the aspect in which the grip portion is provided on the output tray.

FIGS. 13A to 17 are views to describe mechanisms that make it easy for a user to remove a paper sheet bundle stacked on the output tray 204. Note that FIGS. 13A, 13B, 15, and 16 are top views each illustrating a schematic configuration of the post-processing apparatus 200, and FIGS. 14 and 17 are rear side views of the post-processing apparatus 200.

After a paper sheet bundle S is dropped and stacked on the output tray 204, the jogger fence 206 is moved in an arrow A direction from a standby position 206*a* illustrated in FIG. 13A based on a command from the controller 250. FIG. 13B illustrates a state where the jogger fence 206 is moved and reaches a sheet removal position 206*b*.

As illustrated in FIG. 14, in a case where the jogger fence 206 is positioned at the standby position 206*a* in the vicinity of a removal port 1410, the jogger fence 206 becomes the obstacle at the time of removal, and the paper sheet bundle S cannot be easily removed from an arrow A' direction. In the present embodiment, at the time of removing the paper sheet bundle S, the jogger fence 206 is moved close to the other jogger fence 205, in other words, the jogger fence 206 is moved in a direction away from the removal port 1410. Thus, a space to remove the paper sheet bundle S can be secured. Note that the jogger fence 206 is moved close to the jogger fence 205 more than the position of the leading end stopper 207 in order to facilitate removal of the paper sheet bundle S as much as possible.

After completion of removal of the paper sheet bundle S, the jogger fence 206 is returned to the standby position 206*a*.

Meanwhile, a sensor that detects a current position of the jogger fence 206 is provided at one or both of the standby positions 206*a* and the sheet removal position 206*b*. The controller 250 can determine, based on a detection signal of the sensor, which one of the positions the jogger fence 206 is currently positioned.

The present embodiment also allows removal of the paper sheet bundle S from the rear side surface. In a case where the leading end stopper 207 is positioned at a standby position 207*a* illustrated in FIG. 15, the leading end stopper 207 becomes an obstacle, and the paper sheet bundle S cannot be easily removed from an arrow B' direction illustrated in FIG. 15. Accordingly, in the present embodiment, at the time of removing the paper sheet bundle S, the leading end stopper 207 is moved from the standby position 207*a* to a sheet removal position 207*b* in an arrow B direction, in other words, in a direction away from a removal port 1501. Thus, the removal of the paper sheet bundle S from the removal port 1501 is facilitated. After completion of removal of the paper sheet bundle S, the leading end stopper 207 is returned to the standby position 207*a*.

Note that the following description is provided by mainly referring to the movement of the jogger fence 206 and assuming that the paper sheet bundle S is removed from the arrow A' direction illustrated in FIG. 13A. However, the description is also applicable to movement of the leading end stopper 207 and the removal from the arrow B' direction illustrated in FIG. 15.

FIGS. 16 and 17 are views illustrating a state in which a grip portion 204*a* is provided at the output tray 204 in addition to the above-described components in order to allow a user to hold the grip portion and pull out the output tray 204. After the jogger fence 206 is moved to the sheet removal position 206*b*, the user holds the grip portion 204*a* and pulls the output tray 204 in an arrow C direction. Thus, a part or all of a paper sheet bundle S stacked on the output tray 204 is exposed to the outside of the apparatus. Therefore, the paper sheet bundle S is more easily removed.

Figure 18:
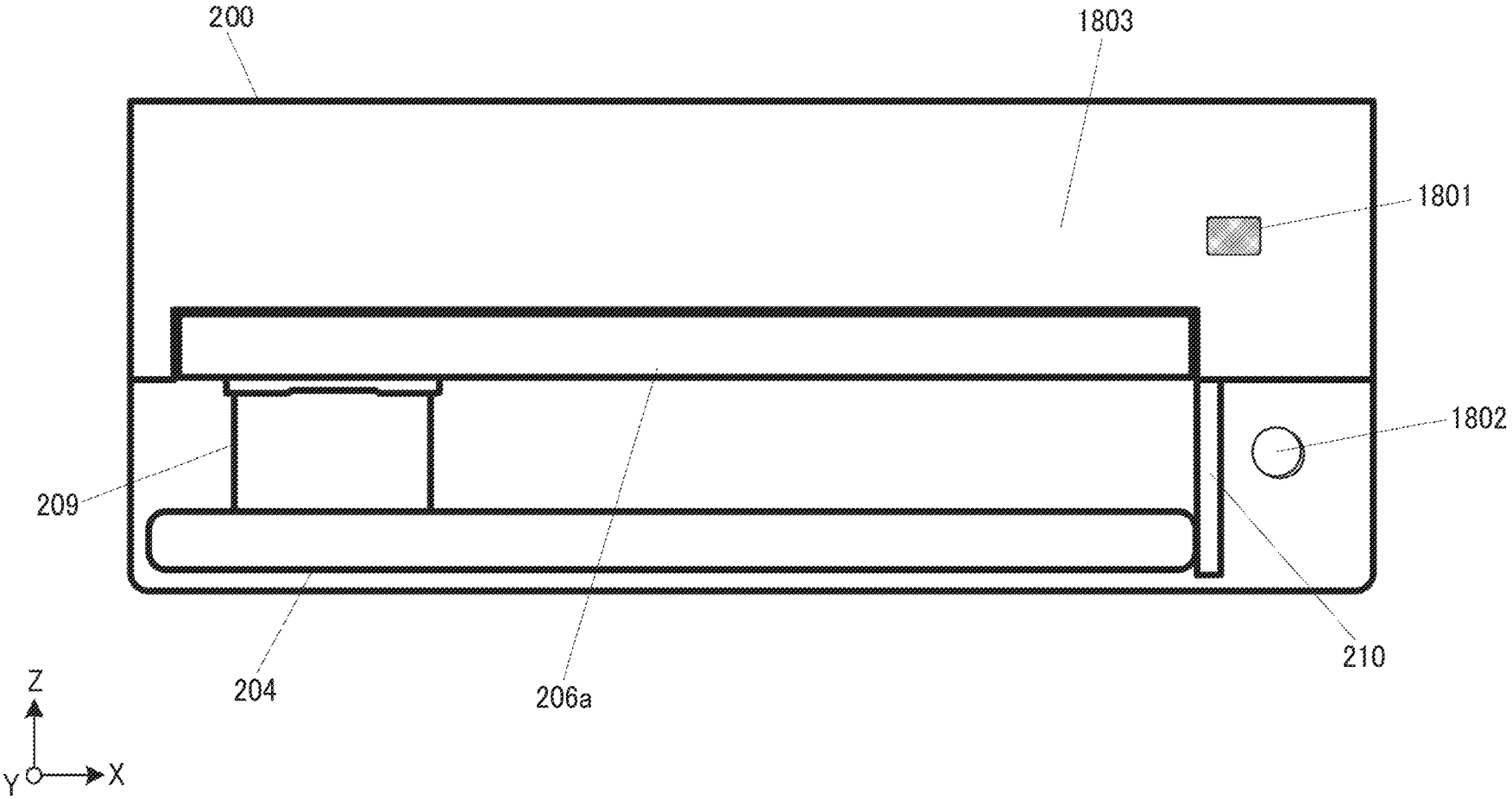
FIG. 18 is a view illustrating an exterior of the post-processing apparatus according to the embodiment and also the view to describe an aspect in which a side surface of the jogger fence is a part of the exterior.
Figure 19:
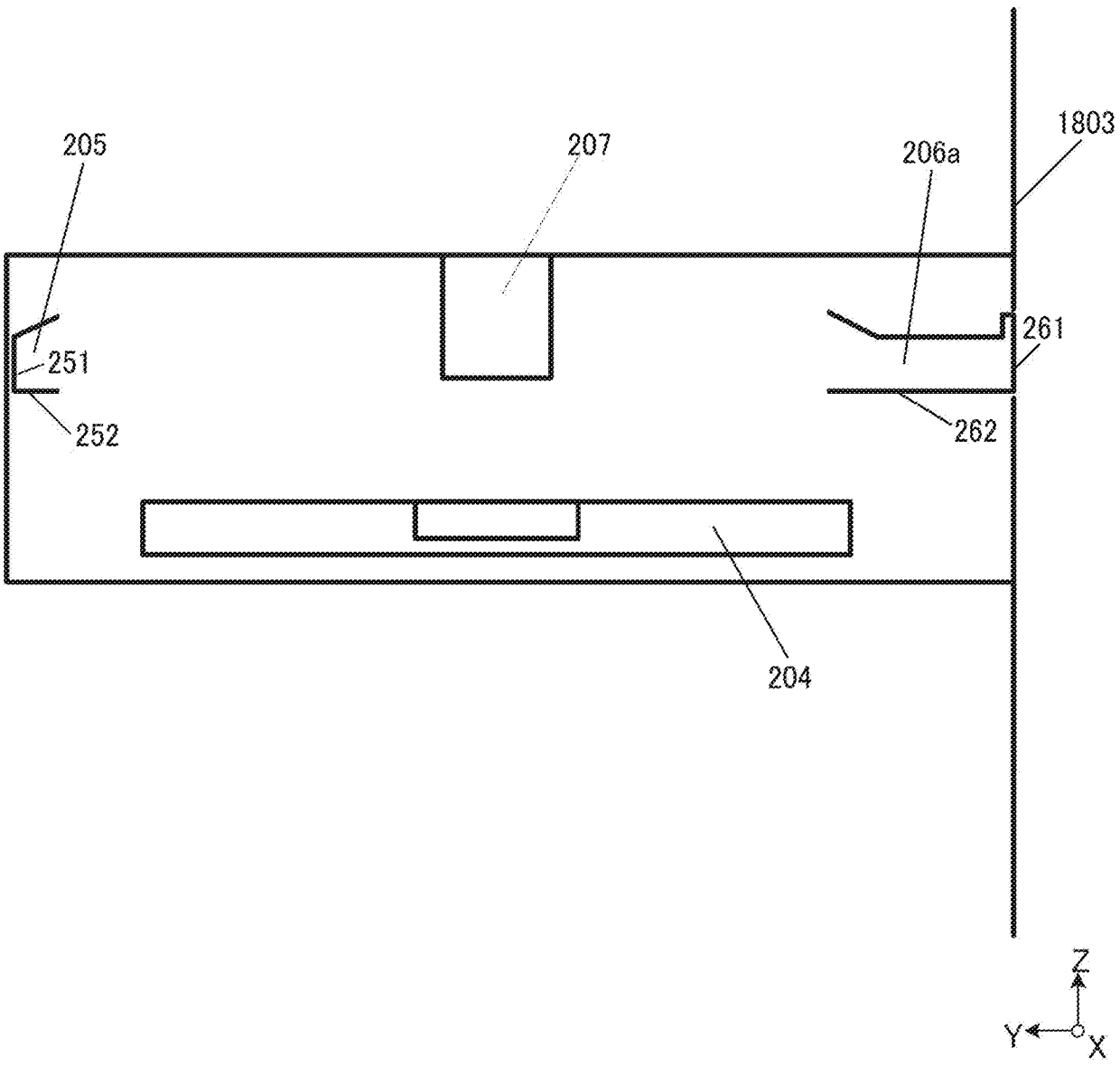
FIG. 19 is a rear side view of the aspect in FIG. 18.

FIGS. 18 and 19 each illustrate a configuration in which the jogger fence 206 also serves as an exterior. In FIGS. 18 and 19, in a case where the jogger fence 206 is positioned at the standby positions 206*a*, a flat surface having no level difference is formed by: the sheet alignment member 261 that is one side surface of the jogger fence 206; and an exterior surface 1803 of the post-processing apparatus 200. When the jogger fence 206 is moved from the standby position 206*a* to the sheet removal position 206*b*, a part of the exterior covered with the one side surface (sheet alignment member 261) of the jogger fence 206 is opened, and a removal port (or a part of the removal port) is formed. With this implementation, the jogger fence 206 can also function as a lid that covers the removal port. Additionally, a user can determine, from visual check on the exterior, whether the jogger fence 206 is moved so as to obtain a state in which the paper sheet bundle S can be removed.

Furthermore, as illustrated in FIG. 18, the exterior of the post-processing apparatus 200 includes a human-presence sensor 1801 that emits infrared to detect whether the user is present in the vicinity. The exterior further includes an eject button 1802 to be operated by the user in order to release a locked state so that the output tray 204 can be pulled out. Since these components are provided, in the case where the user is present in the vicinity or in a case where the eject button 1802 is operated, the controller 250 can move the jogger fence 206 from the standby position 206*a* to the sheet removal position 206*b*.

Figure 20:
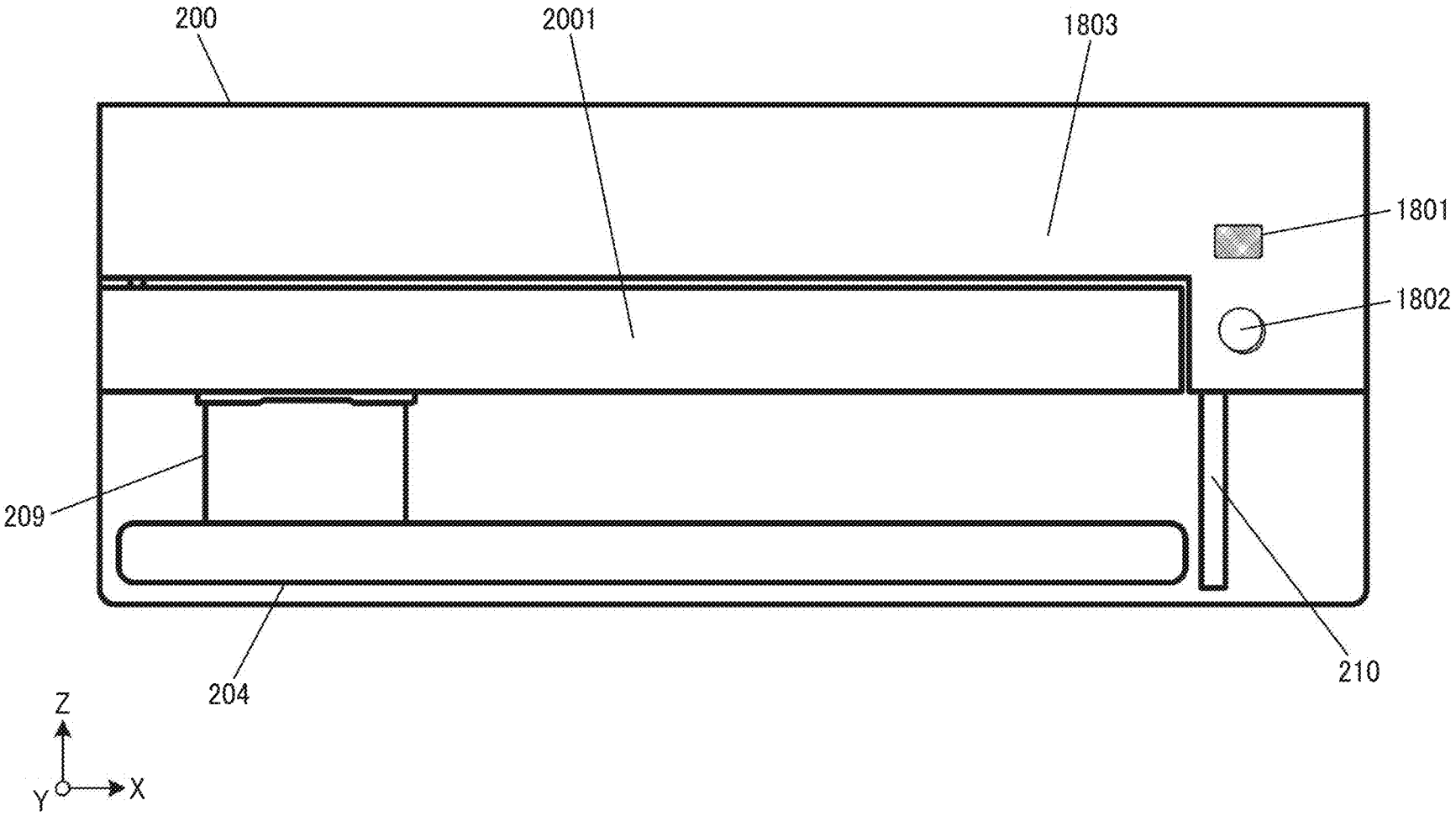
FIG. 20 is a view illustrating the exterior of the post-processing apparatus according to the embodiment and also the view to describe an aspect including an exterior cover that is moved in conjunction with movement of the jogger fence.
Figure 21:
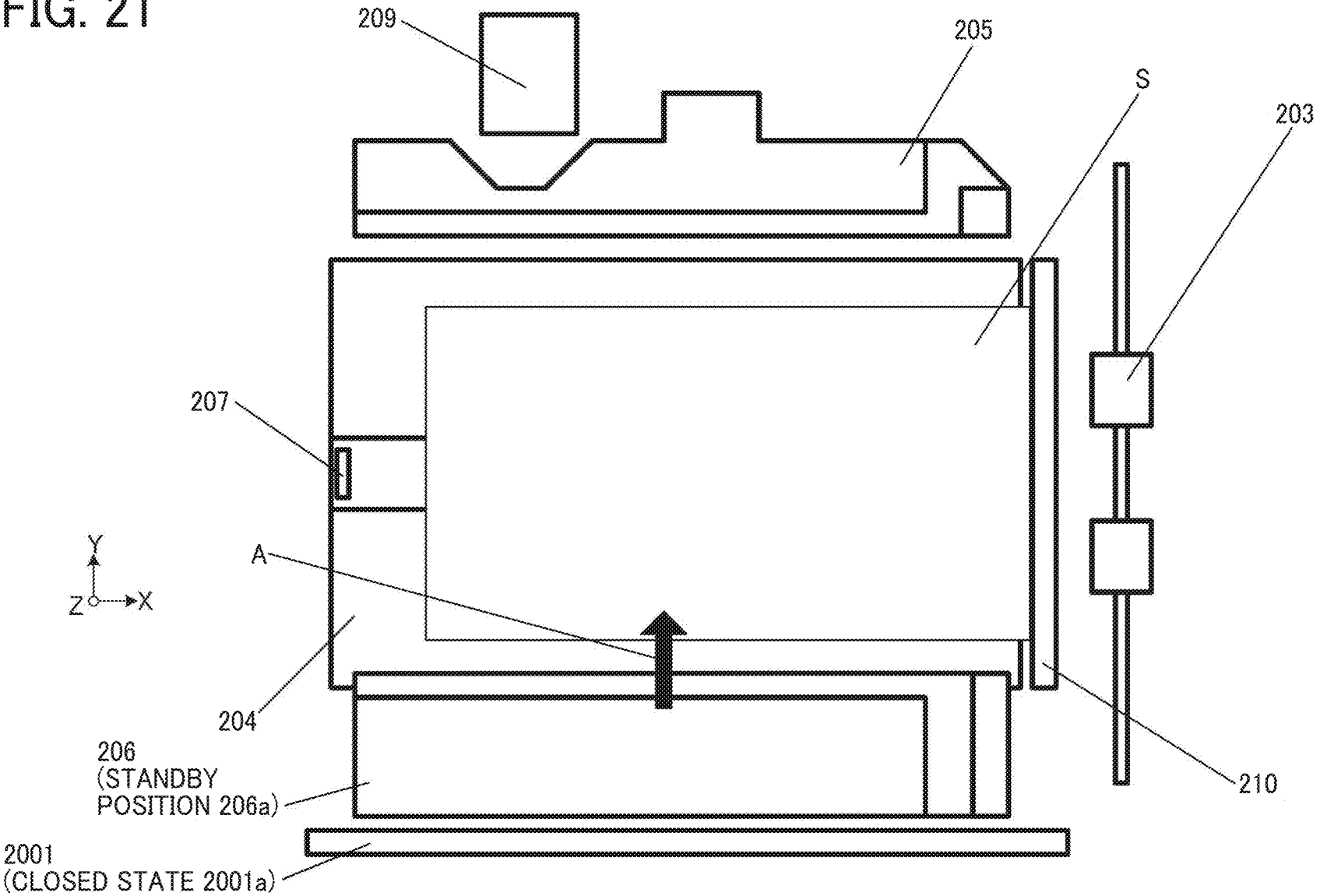
FIG. 21 is a view of the post-processing apparatus according to the embodiment to describe the aspect including the exterior cover that is moved in conjunction with the movement of the jogger fence.
Figure 22:
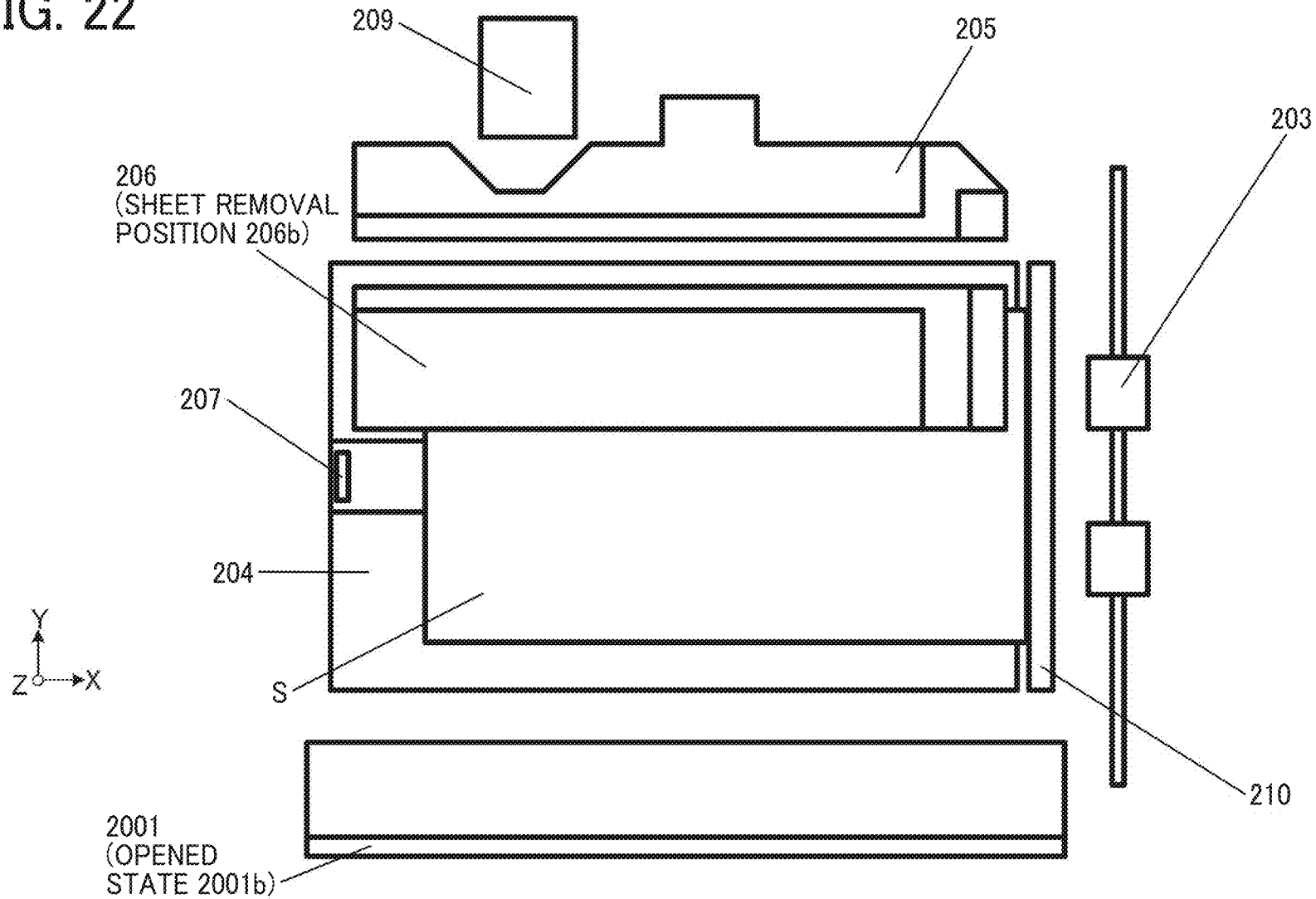
FIG. 22 is a top view of the post-processing apparatus according to the embodiment to describe the aspect including the exterior cover that is moved in conjunction with the movement of the jogger fence.
Figure 23:
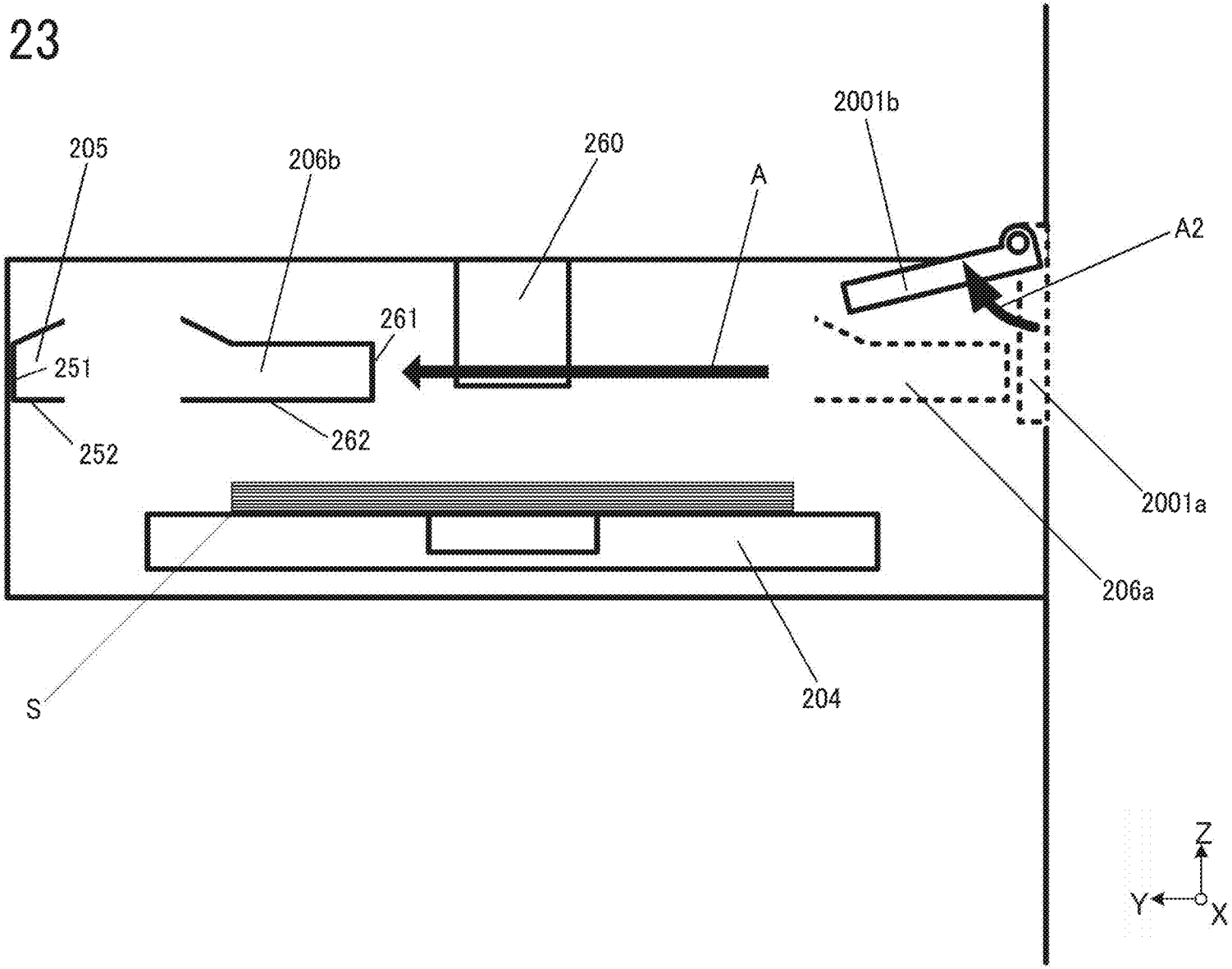
FIG. 23 is a rear side view of the post-processing apparatus according to the embodiment to describe the aspect including the exterior cover that is moved in conjunction with the movement of the jogger fence.

As a different example of the aspect described in FIGS. 18 and 19, a configuration in which a part of the exterior surface 1803 is movable in an openable manner will be described with reference to FIGS. 20 to 23. FIG. 20 is a side view of the post-processing apparatus 200 including a movable exterior cover 2001, and FIGS. 21 and 22 are top views of the same. FIG. 23 is a rear side view to describe the configuration.

The exterior surface 1803 includes the movable exterior cover 2001 that is openable. In a case where the jogger fence 206 is positioned at the standby position 206*a* illustrated in FIG. 21, the exterior cover 2001 is in a closed state 2001*a* so as to cover the jogger fence 206 (see also FIG. 23).

When the jogger fence 206 is moved from the standby position 206*a* to the sheet removal position 206*b* illustrated in FIG. 22, the exterior cover 2001 is rotated in an arrow A2 direction (see FIG. 23) in conjunction with the movement of the jogger fence 206 to change the closed state 2001*a* to an opened state 2001*b*. Thus, a removal port (or a part of the removal port) is formed.

With this aspect, similar to the case described in FIGS. 18 and 19, the user can determine, from the visual check on the exterior, whether the jogger fence 206 is moved so as to obtain the state in which the paper sheet bundle S can be removed.

Figure 24:
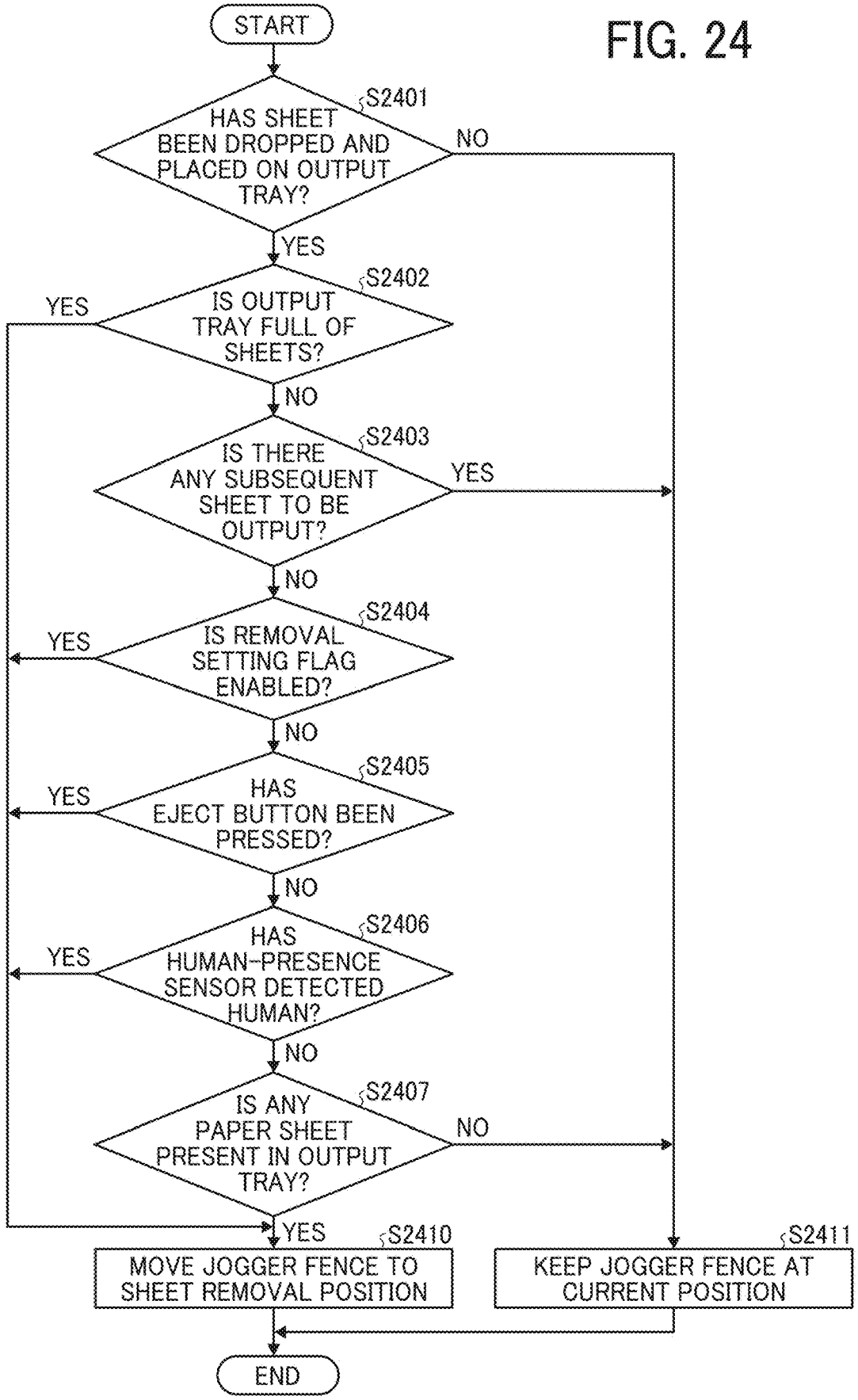
FIG. 24 is a flowchart illustrating exemplary operation of the embodiment.

FIG. 24 is a flowchart illustrating exemplary control operation when the jogger fence 206 is moved from the standby position 206*a* to the sheet removal position 206*b*. In the flowchart of FIG. 24, note that it is assumed that the jogger fence 206 is positioned at the standby position 206*a* as an initial state.

The controller 250 determines whether output of all of sheets is completed and a paper sheet bundle S is dropped (S2401). In a case where the paper sheet bundle S is not dropped (S2401: No), the jogger fence 206 is not moved (S2411), and processing is returned to S2401.

In the case where the paper sheet bundle S is dropped (S2401: Yes), the controller 250 determines whether the output tray 204 is full of the paper sheet bundle S (S2402). For example, a sensor to detect a stacking height of the paper sheet bundle S (sheet stacking height) on the output tray 204 is provided in advance, a detection value of the sensor is received in the controller 250 so as to determine whether the detection value has reached a prescribed height. Thus, it is possible to determine whether the output tray 204 is full. In the case where the output tray 204 is full (S2402: Yes), the controller 250 moves the jogger fence 206 from the standby position 206*a* to the sheet removal position 206*b* (S2410), and the processing is returned to S2401.

In a case where the output tray 204 is not full (S2402: No), the controller 250 determines whether there is any subsequent paper sheet continuously output from the image forming apparatus 100 at this moment (S2403). Such determination is made based on: information associated with a processing state obtainable from the image forming apparatus 100; and an output signal from a sheet detection sensor provided in each conveyance path. In a case where there is the subsequent paper sheet to be output (S2403: Yes), the jogger fence 206 is not moved (S2411).

On the other hand, in a case where there is no paper sheet to be continuously output (S2403: No), the controller 250 determines whether a prescribed value is set for a removal setting flag (S2404). In the present embodiment, the "removal setting flag" is provided. In a case where a user sets the prescribed value for this flag, control is executed after the paper sheet bundle S is dropped such that the jogger fence 206 is surely moved to the sheet removal position 206*b* regardless of other situations. In the case where the prescribed value is set for the removal setting flag (S2404: Yes), the controller 250 moves the jogger fence 206 to the sheet removal position 206*b* (S2410).

In the case where no prescribed value is set for the removal setting flag (S2404: No), the controller 250 determines whether the eject button 1802 has been pressed (S2405), and further determines whether the human-presence sensor 1801 has detected the user (S2406). In a case where any one of these determination results is affirmative (S2405: Yes, or S2406: Yes), the controller 250 moves the jogger fence 206 to the sheet removal position (S2410). On the other hand, in a case where both of the determination results are negative (S2405: No and S2406: No), the processing proceeds to S2407.

Figure 25:
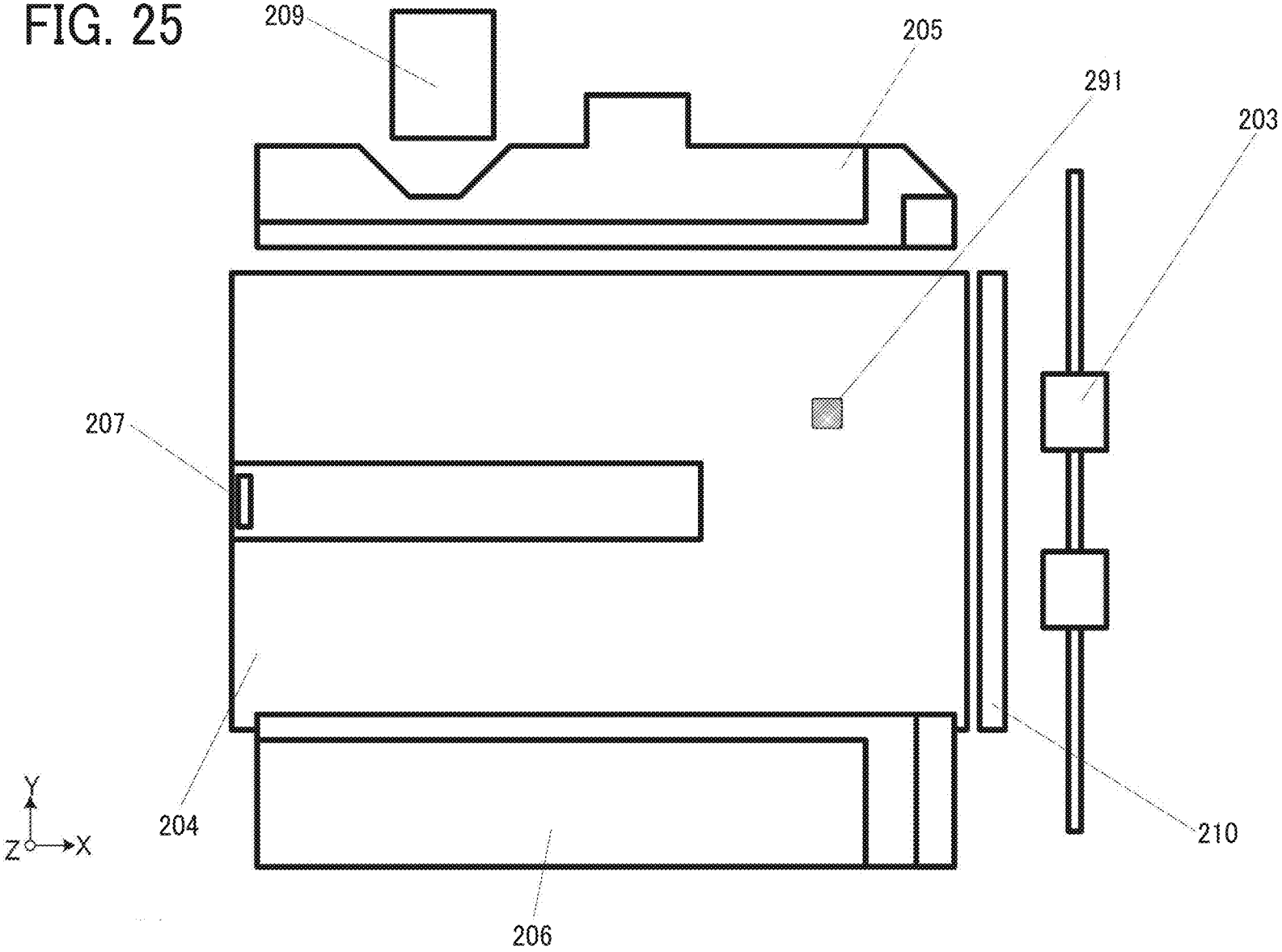
FIG. 25 is a top view illustrating disposition of a tray paper presence/absence sensor according to the embodiment.

The controller 250 determines whether any paper sheet is present in the output tray 204 (S2407). As illustrated in FIG. 25, a tray paper presence/absence sensor 291 that emits infrared is provided above a sheet placement surface of the output tray 204. The tray paper presence/absence sensor 291 is provided at a position where a paper sheet of any size can be detected.

The controller 250 can determine presence or absence of a paper sheet by receiving a signal from the tray paper presence/absence sensor 291. In a case where a paper sheet is present in the output tray 204 (S2407: Yes), the controller 250 moves the jogger fence 206 to the sheet removal position 206*b* (S2410). In a case where a paper sheet is absent in the output tray 204 (S2407: No), the jogger fence 206 is not moved (S2411).

Note that, after the jogger fence 206 is moved to the sheet removal position 206*b*, in a case where a paper sheet bundle S is removed by the user and the tray paper presence/absence sensor 291 detects no sheet, in a case where the human-presence sensor is turned from ON to OFF, or in a case where the output tray 204 is changed from the opened state to the closed state, the jogger fence 206 is returned to the standby position 206*a*.

In the above description, a sheet bundle mainly including a plurality of paper sheets (sheets) is set as a processing target. However, needless to mention, the above processing is also applicable to a case of processing only one paper sheet (sheet).

In the above description, it is also described that: among respective adjustment members including the jogger fences 205 and 206 and the leading end stopper 207, the jogger fence 206 or the leading end stopper 207 is positioned on the sheet removal port side, and these adjustment members are moved in a direction opposite to the sheet removal port at the time of removing a paper sheet. On the other hand, in a case where the jogger fence 205 is positioned on the sheet removal port side, the jogger fence 205 is moved in the direction opposite to the sheet removal port. In other words, in the above, the description is provided for the exemplary implementation in which the adjustment member positioned on the sheet removal port side is moved in the direction opposite to the sheet removal port.

Also, in the above description, the description is provided for the exemplary implementation in which a paper sheet is interposed and aligned by using the plurality of adjustment members such as the jogger fences 205 and 206 and the leading end stopper 207. However, the aspect is not limited thereto. For example, the paper sheet may be interposed and aligned between one of wall surfaces of a tray housing and one adjustment member. Thus, the number of adjustment members may be one.

The sheet stacking device corresponds to a configuration including the jogger fences 205 and 206, the leading end stopper 207, the output tray 204, and the controller 250. The first sheet stacking unit corresponds to a configuration including the pair of sheet stackers 252 and 262 (first sheet stackers) and the controller 250. The sheet alignment device corresponds to a configuration including the pair of sheet alignment members 251 and 261 and the controller 250. A second sheet stacking unit corresponds to a configuration including the output tray 204 and the controller 250. An exterior opening/closing device corresponds to a configuration including the exterior cover 2001 and the controller 250.

A detection device corresponds to a configuration including the tray paper presence/absence sensor 291 and the controller 250. A human detection device corresponds to a configuration including the human-presence sensor 1801 and the controller 250. An operation device corresponds to a configuration including the eject button 1802 and the controller 250. A stacking height detection device corresponds to a configuration including the sensor that detects a stacking height of a paper sheet bundle S and the controller 250 which are used in the above-described determination in S2402.

In the above-described embodiment, the description is provided for the sheet stacking device including: the first sheet stacking unit including the pair of first sheet stackers (252 and 262) that stack both end portions of a sheet to be ejected, the end portions being in the direction orthogonal to the ejecting direction of the sheet; the sheet alignment device including the pair of sheet alignment members (251 and 261) that align a sheet by contacting both ends in the direction orthogonal to the ejecting direction of the sheet stacked in the first sheet stackers; and the second sheet stacking unit including the second sheet stacker (204) that is positioned lower than the first sheet stackers and stacks the sheet dropped from between the first sheet stackers. Additionally, the description is also provided for the fact that the sheet stacking device drops a sheet from between the first sheet stackers, and then moves the first sheet stacker (262) and the sheet alignment member (261) to another direction on an opposite side of the removal port (1410) that is positioned in one side in the direction orthogonal to the ejecting direction and used to remove the sheet.

Furthermore, in the above embodiment, the description is also provided for the fact that the first sheet stacker (262) and the sheet alignment member (261) which are positioned on the one side in the direction orthogonal to the ejecting direction are moved in mentioned another direction after the sheet is dropped from between the first sheet stackers.

As described above, according to the present embodiment, it is possible to easily remove a sheet or a sheet bundle stacked on the output tray.

Note that the sheet stacking device according to the above-described embodiment can also be expressed as follows. In other words, it can be expressed that the sheet stacking device includes the adjustment members (the jogger fences 205 and 206, the leading end stopper 207, and the like) that align a sheet (paper sheet), and further includes the sheet alignment device that moves, after the alignment of end portions of the sheet by the adjustment members, the adjustment members in the respective predetermined directions to form the state in which the sheet is dropped by its own weight; and the sheet stacking unit that includes the stacker (the output tray 204) positioned below the adjustment members and stacks, in this stacker, the sheet dropped from the adjustment members. The sheet alignment device moves the adjustment members in the predetermined respective directions to drop the sheet, and then moves the part of the adjustment members in directions opposite to the respective predetermined directions.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet stacking device comprising:

a pair of first sheet stackers configured to stack both end portions of a sheet to be ejected, the end portions being end portions of the sheet in a direction orthogonal to an ejecting direction of the sheet;

a pair of sheet alignment members configured to contact both ends of the sheet in the direction orthogonal to the ejecting direction of the sheet to align the sheet on the pair of first sheet stackers;

a second sheet stacker disposed lower than the pair of first sheet stackers and configured to stack the sheet dropped from between the pair of first sheet stackers;

a sheet removal portion disposed on one side in the direction orthogonal to the ejecting direction of the sheet and configured to provide access to the sheet to facilitate removal of the sheet; and control circuitry configured to, cause one first sheet stacker of the pair of first sheet stackers and one sheet alignment member of the pair of sheet alignment members to move toward an opposite side of the sheet removal portion in the direction orthogonal to the ejecting direction of the sheet after the sheet is dropped from between the pair of first sheet stackers, and cause the one first sheet stacker and the one sheet alignment member not to move when there is a sheet to be continuously conveyed after the sheet is dropped.

2. The sheet stacking device according to claim 1, wherein the one first sheet stacker and the one sheet alignment member are disposed on the one side in the direction orthogonal to the ejecting direction of the sheet, wherein, after the sheet is dropped from between the pair of first sheet stackers, the control circuitry causes the one first sheet stacker and the one sheet alignment member to move from the one side to the opposite side of the sheet removal portion in the direction orthogonal to the ejecting direction of the sheet.

3. The sheet stacking device according to claim 1, further comprising a detection device configured to detect presence or absence of the sheet stacked on the second sheet stacker, wherein the control circuitry causes the one first sheet stacker and the one sheet alignment member to move when the sheet is detected by the detection device.

4. The sheet stacking device according to claim 1, further comprising a human detection device configured to detect presence or absence of a human, wherein the control circuitry causes the one first sheet stacker and the one sheet alignment member to move when the human is detected by the human detection device.

5. The sheet stacking device according to claim 1, further comprising an operation device configured to receive an operation of a human, wherein the control circuitry causes the one first sheet stacker and the one sheet alignment member to move when the operation device receives the operation.

6. The sheet stacking device according to claim 1, further comprising a stacking height detection device configured to detect a stacking height of sheets stacked on the second sheet stacker, wherein the control circuitry causes the one first sheet stacker and the one sheet alignment member to move when the stacking height detected by the stacking height detection device is equal to or greater than a prescribed value.

7. The sheet stacking device according to claim 1, wherein the second sheet stacker includes a grip portion to allow a human to hold the grip portion and pull out the second sheet stacker.

8. The sheet stacking device according to claim 1, wherein the one sheet alignment member is part of an exterior of the sheet stacking device in a state before the one first sheet stacker and the one sheet alignment member are moved.

9. The sheet stacking device according to claim 1, further comprising an exterior opening-and-closing device configured to open and close a part of an exterior of the sheet stacking device in conjunction with movement of the one first sheet stacker and the one sheet alignment member.

10. The sheet stacking device according to claim 1, wherein the one first sheet stacker and the one sheet alignment member are molded as a single component.

11. An image forming system comprising:

an image forming apparatus configured to form an image on a sheet; and the sheet stacking device according to claim 1, configured to stack the sheet having the image formed by the image forming apparatus.

* * * * *